US009300027B2

(12) United States Patent
Mitake et al.

(10) Patent No.: US 9,300,027 B2
(45) Date of Patent: Mar. 29, 2016

(54) DIRECTIONAL COUPLER

(71) Applicant: TDK Corporation, Tokyo (JP)

(72) Inventors: Yukio Mitake, Tokyo (JP); Hajime Kuwajima, Tokyo (JP)

(73) Assignee: TDK Corporation, Tokyo (JP)

( * ) Notice: Subject to any disclaimer, the term of this patent is extended or adjusted under 35 U.S.C. 154(b) by 388 days.

(21) Appl. No.: 13/752,889

(22) Filed: Jan. 29, 2013

(65) Prior Publication Data

US 2013/0194055 A1 Aug. 1, 2013

(30) Foreign Application Priority Data

Feb. 1, 2012 (JP) ..... 2012-020258

(51) Int. Cl.
*H01P 5/18* (2006.01)

(52) U.S. Cl.
CPC ..... *H01P 5/184* (2013.01); *H01P 5/185* (2013.01)

(58) Field of Classification Search
CPC ..... H01P 5/184
USPC ..... 333/116
See application file for complete search history.

(56) References Cited

U.S. PATENT DOCUMENTS 3,999,150 A * 12/1976 Caragliano ..... H01P 5/185 333/116
5,369,379 A * 11/1994 Fujiki ..... H01P 5/185 333/116
5,557,245 A * 9/1996 Taketa ..... H01P 5/187 333/116
5,742,210 A * 4/1998 Chaturvedi ..... H01P 5/187 333/116
6,747,525 B2 6/2004 Iida et al.
6,771,141 B2 8/2004 Iida et al.
7,245,192 B2 * 7/2007 Podell ..... H01P 5/187 333/112
7,961,064 B2 * 6/2011 Kearns et al. ..... 333/109

(Continued)

FOREIGN PATENT DOCUMENTS

CN 1412887 A 4/2003
JP 8-191206 7/1996
JP 8-237011 9/1996

(Continued)

OTHER PUBLICATIONS

Combined Chinese Office Action and Search Report issued Aug. 21, 2014 in Patent Application No. 201310041422.9 with English Translation and English Translation of Category of Cited Documents.

*Primary Examiner* — Dean Takaoka
*Assistant Examiner* — Alan Wong
(74) *Attorney, Agent, or Firm* — Oblon, McClelland, Maier & Neustadt, L.L.P.

(57) ABSTRACT

A directional coupler has a first line capable of transmitting a high-frequency signal therethrough and a second line arranged for electromagnetic coupling with the first line in a laminated board. The first line and the second line are routed on a first conductor layer to extend in close proximity to and in parallel with each other, to form an intra-layer coupling zone for developing electromagnetic coupling between the first line and the second line. The second line is routed on a second conductor layer such that the second line partially overlaps with the first line disposed on the first conductor layer with respect to a length-wise direction, when viewed in plan, to form an inter-layer coupling space for developing electromagnetic coupling between the second line on the second conductor layer and the first line on the first conductor layer.

3 Claims, 28 Drawing Sheets

(56) References Cited

U.S. PATENT DOCUMENTS

| | | | | |
|---|---|---|---|---|
| 2005/0062557 | A1* | 3/2005 | Kang et al. | 333/116 |
| 2008/0070519 | A1 | 3/2008 | Okabe | |

FOREIGN PATENT DOCUMENTS

| | | |
|---|---|---|
| JP | 2002-280810 | 9/2002 |
| JP | 2008-78853 | 4/2008 |

* cited by examiner

[FIRST LAYER]

[FIRST INSULATING LAYER]

[SECOND LAYER]

[FOURTH LAYER]

[FOURTH INSULATING LAYER]

[FIFTH LAYER]

[FIFTH INSULATING LAYER]

[SIXTH LAYER]

[SIXTH INSULATING LAYER]

[SEVENTH LAYER]

[SEVENTH INSULATING LAYER]

[EIGHTH LAYER]

DIRECTIONAL COUPLER

BACKGROUND OF THE INVENTION

The present invention relates to a directional coupler, and more particularly, to arrangements and structures of conductor patterns for accomplishing both of reduction in size and height and good electrical characteristics of the directional coupler.

A directional coupler (hereinafter simply referred to as the "coupler") which has a function of branching or combining high frequency power propagated on a transmission line has become an indispensable component for designing a transmitter circuit for a variety of wireless communication devices such as portable telephones, wireless LAN communication device, communication devices based on Bluetooth (registered tradename) standard, and the like.

The coupler comprises a first line which has a first port at one end and a second port at the other end, respectively, and a second line which has a third port on one end and a fourth port on the other end, respectively. The first line and second line are disposed in close proximity to each other such that they are electromagnetically coupled to each other.

Such a coupler comprising coupling lines can be used as detector means for monitoring a transmitter circuit of a communication device for the level of a transmitted signal. Specifically, the coupler is inserted between a power amplifier (PA) for amplifying the transmitted signal and an antenna. The transmitted signal from PA is inputted to a first line (primary line) through a first port (input port) of the coupler, and is then outputted from a second port (output port) toward the antenna. In this event, part of the transmitted signal propagating through the first line is extracted through a second line (secondary line) which electromagnetically couples to the first line, and outputted from a third port (coupling port) to an automatic output control circuit (APC circuit) as a monitor signal. The APC circuit controls the gain of PA such that PA provides a constant output in accordance with the level of the monitor signal (i.e., the level of the transmitted signal). Such a PA feedback control enables the transmission output to be stabilized.

The coupler can also divide high-frequency power to two lines with a phase difference of 90°, or can combine high-frequency power from two lines with a phase difference of 90°. As such, the coupler can also be used, for example, for a differential power amplifier as an input divider or as an output combiner. Specifically, the coupler can be applied with a transmitted signal from the first port, divide the transmitted signal into two halves, and output the halves from the second port and third port, respectively, with a phase difference of 90°. In this way, the coupler can be used for a differential power amplifier as an input divider. Alternatively, the coupler can be applied with high-frequency signals with a phase difference of 90° from the second port and third port, respectively, combine these signals, and deliver the resulting single signal from the first port. In this way, the coupler can also be used for a differential power amplifier as an output combiner.

Further, the following patent documents disclose such couplers:

Patent Document 1: JP-A-2002-280810; and

Patent Document 2: JP-A-8-191206.

SUMMARY OF THE INVENTION

For designing a coupler, satisfactory characteristics can be generally achieved in a used frequency band when the length of a first line and a second line is set to be approximately one-quarter wavelength of the used frequency band.

However, in regard to a sub-microwave band mainly used for mobile wireless devices such as portable phones, the one-quarter wavelength is as long as several centimeters. Thus, it is not feasible from a viewpoint of the size to employ coupling lines of this length for a coupler for use in a mobile wireless device such as portable phone, which is required to be reduced in weight, thickness, length, and size. Also, the employment of long coupling lines of several centimeters or more would cause fatal disadvantages for the mobile wireless device, such as an extremely larger insertion loss which would result in a significantly shortened battery lifetime. For this reason, couplers generally employed in this application have coupling lines shorter than one-quarter wavelength of used frequency band, however, ideal characteristics cannot be easily accomplished with such couplers.

Here, known methods of forming coupling lines involve disposing two lines in close proximity to and in parallel with each other on the same plane (on the same conductor layer) to make coupling between the two lines (hereinafter such a coupling form is referred to as "intra-layer coupling"), as implemented by the invention described in Patent Document 1 cited above, or disposing a first line and a second line on different conductor layers, respectively, such that they overlap with each other when viewed in plan (hereinafter, such a coupling form is referred to as "inter-layer coupling), as implemented by the invention described in Patent Document 2 cited above. Although a larger number of layers are required, the inter-layer coupling allows the planes of both lines to be placed opposite to each other and coupled to each other, and is therefore advantageous in that the coupling of both lines can be made stronger to provide satisfactory characteristics.

FIGS. 35A-35O show an exemplary structure of a coupler which is formed with coupling lines by such inter-layer coupling. As shown in these figures, this coupler (hereinafter referred to as the "comparison example") employs a laminated board which has a total of eight conductor layers from a first to an eighth layer. A first line 12 is formed in a spiral shape on the third and sixth layers, respectively, through via holes (hereinafter simply referred to as the "via") V1. A second line 13 is formed in a spiral shape on the second and fifth layers through vias V2. The third layer (FIG. 35E) and second layer (FIG. 35C) are placed such that the first line 12 on the third layer overlaps with the second line 13 on the second layer, when viewed in plan, thereby developing the inter-layer coupling of these lines 12, 13. Similarly, the sixth layer (FIG. 35K) and fifth layer (FIG. 35I) are placed such that the first line 12 on the sixth layer overlaps with the second line 13 on the fifth layer, when viewed in plan, thereby developing the inter-layer coupling of the lines 12, 13.

While FIGS. 35A-35O show the respective layers of the laminated board from the top layer to lower layers in order (the same goes for FIGS. 2A-2K, later described, as well), in the present application, layers disposed with conductor patterns, among these layers of the board, are referred to as a first layer, a second layer, . . . from the top layer toward lower layers in order, and layers disposed with no conductor patterns except for vias V, V1, V2 are referred to as a first insulating layer, a second insulating layer, . . . from the top layer to lower layers in order (the same goes for embodiments described below). Also, a "first conductor layer" as recited in claims may refer to any of the first layer, second layer, . . . for example, disposed with a conductor pattern, and a "second conductor layer" as recited in claims refers to any of the first layer, second layer, . . . , for example, disposed with a conductor pattern and different from the first conductor layer.

Further, in the figures, reference numeral P1 designates a first port; P2, a second port; P3, a third port; and P4, a fourth port, respectively. Also, the coupler is assumed to be used in a 2.6-GHz band, and can have functional layers, the size of which may be 1.0 mm long, 0.5 mm wide, and 0.142 mm high (thick). FIGS. 36A-36D in turn represent frequency characteristics (reflection loss, insertion loss, coupling degree, isolation, and phase difference) of the coupler according to the comparison example, which can adequately satisfy respective specifications S1-S4 that are required at present.

However, the foregoing structure of the coupler requires four conductor layers for forming the coupling lines, causing the height dimension of the coupler to be large. On the other hand, when an attempt is made to reduce the height (number of layers), the planar shape inevitably becomes larger to compensate for the reduced height. In addition, further improvements in characteristics are requested to keep abreast with increasing reduction in size and thickness of devices and with incorporation of more functions and higher functions in the devices. The aforementioned coupler encounters difficulties in responding the request while maintaining the size of the functional layer.

It is therefore an object of the present invention to provide a coupler which is reduced in size and height and exhibits more satisfactory characteristics.

To solve the problem and achieve the object, a coupler (directional coupler) according to the present invention comprises intra-layer coupling which involves disposing two conductor lines in close proximity to and in parallel with each other on the same conductor layer to generate electromagnetic coupling between the two conductor lines, as well as inter-layer coupling which involves disposing two conductor lines on different conductor layers, respectively, such that they overlap with each other in a length-wise direction, when viewed in plan, to generate electromagnetic coupling between the two conductor lines.

Specifically, a coupler according to the present invention is a coupler which comprises, as a basic aspect, a first line capable of transmitting a high-frequency signal therethrough; a second line arranged for electromagnetic coupling with the first line; a first port disposed at one end of the first line; a second port disposed at the other end of the first line; a third port disposed at one end of the second line; and a fourth port disposed at the other end of the second line, wherein the first and second lines and the first, second, third, and fourth ports are arranged in a laminated board having a plurality of conductor layers including a first conductor layer and a second conductor layer laminated through an insulating layer, the first line and the second line are disposed on the first conductor layer, the first line and the second line are routed on the first conductor layer to extend in close proximity to and in parallel with each other, to form an intra-layer coupling zone for developing electromagnetic coupling between the first line and the second line, and the second line is routed on the second conductor layer such that the second line partially overlaps with the first line disposed on the first conductor layer with respect to a length-wise direction, when viewed in plan, to form an inter-layer coupling space for developing electromagnetic coupling between the second line on the second conductor layer and the first line on the first conductor layer.

Also, as preferred aspects, it is preferable to employ respective aspects as described below in the basic aspect for accomplishing a coupler which is reduced in size and height and exhibits satisfactory characteristics.

(1) In the basic aspect described above, the first line is routed on the second conductor layer such that the first line partially overlaps with the second line disposed on the first conductor layer with respect to the length-wise direction, when viewed in plan, to further form an inter-layer coupling space for developing electromagnetic coupling between the first line on the second conductor layer and the second line on the first conductor layer. In this event, the first line may be a primary line, and the second line may be a secondary line, or conversely, the first line may be a secondary line, and the second line may be a primary line (the same goes for the following description).

(2) In the basic aspect or aspect (1) described above, the second line routed on the second conductor layer is arranged to electromagnetically couple to the first line on the intra-layer coupling zone, so that the intra-layer coupling zone is associated with both of intra-layer coupling which is electromagnetic coupling on the same conductor layer and inter-layer coupling which is electromagnetic coupling across different conductor layers.

(3) In the aspect (2) described above, the first line routed on the second conductor layer is arranged to electromagnetically couple to the second line in the intra-layer coupling zone, so that the intra-layer coupling zone is associated with both of intra-layer coupling which is electromagnetic coupling on the same conductor layer and inter-layer coupling which is electromagnetic coupling across different conductor layers.

(4) In the aspect (2) or (3) described above, the directional coupler comprises a double coupling space which is associated simultaneously with the intra-layer coupling and the inter-layer coupling, where the first line and second line are disposed within the laminated board such that the double coupling space is formed in a loop shape.

(5) In the basic aspect described above, the laminated board is rectangular in shape when viewed in plan, the first conductor layer and the second conductor layer are both arranged horizontally within the laminated board and each have a first corner, a second corner adjacent to the first corner, a third corner located diagonal to the first corner when viewed in plan, and a fourth corner located diagonal to the second corner. The first port is disposed at a first corner on the first conductor layer, and the third port is disposed at a second corner adjacent to the first corner on the first conductor layer. The first line extending from the first port and the second line extending from the third port extend in close proximity to and in parallel with each other to form the intra-layer coupling zone on the first conductor layer, and the first line and the second line spirally extend to each draw a spiral from a peripheral area to a central area of the first conductor layer, and the first line is connected to a first via hole in the central area of the first conductor layer, and is routed to a central area of the second conductor layer through the first via hole, and the second line is connected to a second via hole and routed to the central area of the second conductor layer through the second via hole. The third port is disposed at one of the third corner and fourth corner on the second conductor layer, and the fourth port is disposed at the other of the third corner and fourth corner on the second conductor layer. The first line extending from the first via hole to the second port and the second line extending from the second via hole to the fourth port extend in close proximity to and in parallel with each other to form the intra-layer coupling zone within the second conductor layer, where the first line and second line spirally extend to each draw a spiral from a central area to a peripheral area of the second conductor layer. The intra-layer coupling zone spirally extending on the first conductor layer overlaps with the intra-layer coupling zone spirally extending on the second conductor layer, when viewed in plan, such that the first line on the first conductor layer and the second line on the second conductor layer overlap with each other, while the second line on the first conductor layer and the first line on the second conductor layer overlap with each other, when viewed in plan, to form the inter-layer coupling space, in a manner that a double coupling space is formed for developing the electromagnetic coupling on the same conductor layer and the electromagnetic coupling across different conductor layers.

(6) Also, in the aspect (5) described above, the double coupling space is preferably formed substantially over the entire length of the first and second lines except for an end connected to the first port, an end connected to the third port, an end connected to the second port, an end connected to the fourth port, an end connected to the first via hole, and an end connected to the second via hole, in view of reducing the coupler in size.

(7) Further, in the basic aspect or any of the preferred aspects, the coupler may comprise a terminal resistor disposed within the laminated board to be connected between the second line and the fourth port. According to such an aspect, a coupler can be provided to exhibit satisfactory characteristics even without additionally connecting a terminal resistor to the fourth port.

As described above, the present invention implements, within a single coupler, a combined use of intra-layer coupling which involves a first line and a second line disposed in close proximity to each other to develop coupling therebetween and inter-layer coupling which involves a first line and a second line disposed on different conductor layers such that they overlap with each other, when viewed in plan, to develop coupling therebetween, thereby simultaneously enabling the coupler to be reduced in size and height and to exhibit satisfactory characteristics.

Particularly, by routing the first line and second line such that an intra-layer coupling zone simultaneously forms inter-layer coupling, in other words, by providing a double coupling space which is a line coupling space that provides for intra-layer coupling and inter-layer coupling (serves as an intra-layer coupling zone as well as an inter-layer coupling space), the first and second lines can be enhanced in coupling, as compared with before, thus making it possible for the coupler to exhibit more satisfactory characteristics than before, in spite of its smaller size and lower height. In regard to specific pattern shapes of the coupling lines and their benefits on characteristics, a further discussion will be given in description of embodiments below with reference to the drawings.

While the coupler of the present invention is not particularly limited in its application, the coupler can form part of detecting means, by way of example, for monitoring a transmitted signal for the level in a wireless communication device, as described above. In this application, one of the first line and second line may be a primary line for transmitting a transmitted signal therethrough, and the other may be a secondary line for extracting a monitor signal indicative of the level corresponding to the transmitted signal, and the first port may be used as an input port (or a coupling port); the second port as an output port (or an isolation port); the third port as a coupling port (or an input port); and the fourth port as an isolation port (or an output port), respectively.

Additionally, the coupler can also form part of an input divider or an output combiner for a differential power amplifier as described above. For designing an input divider, a transmitted signal may be inputted from the first port (or third port), and this transmitted signal may be divided into two halves, each of which may be outputted from the second port (or fourth port) and third port (or first port), respectively. Alternatively, for designing an output combiner, high-frequency signals to be combined may be inputted from the second port (or fourth port) and third port (or first port), respectively, and a combined signal may be outputted from the first port (or third port).

According to the present invention, it is possible to accomplish a coupler which is reduced in size and height and exhibits satisfactory characteristics.

Other objects and features of the present invention will become apparent from the following detailed description considered in connection with the accompanying drawings. In the drawings, similar reference characters denote similar elements throughout the several views.

DESCRIPTION OF THE EMBODIMENTS

First Embodiment

Figure 1:
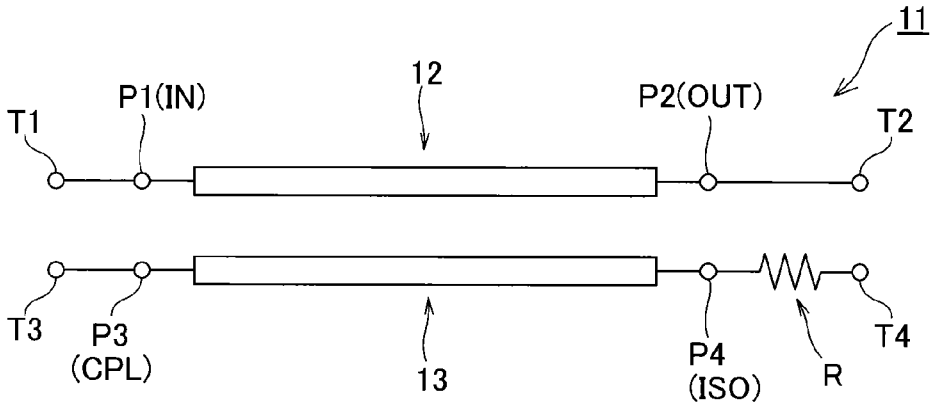
FIG. 1 is a circuit diagram showing a coupler according to a first embodiment of the present invention.

As shown in FIG. 1, a coupler 11 according to a first embodiment of the present invention comprises a primary line 12 for transmitting high-frequency power, and a secondary line 13 for extracting part of the high-frequency power transmitted through the primary line 12, where part of the primary line 12 and part of the secondary line 13 are disposed in close proximity to each other to develop electromagnetic coupling therebetween. The primary line 12 comprises a first port (input port) P1 at one end, and a second port (output port) P2 at the other end, respectively, while the secondary line 13 comprises a third port (coupling port) P3 at one end, and a fourth port (isolation port) P4 at the other end, respectively.

In the following description, the first port is designated as "P1"; the second port as "P2"; the third port as "P3"; and the fourth port as "P4." These ports P1, P2, P3, and P4 are connected to terminals T1, T2, T3, and T4 for external connection, respectively, through vias. Further, a terminal resistor (for example, 50-Ω resistor) is provided between P4 and the fourth terminal T4 for external connection. Also, as described above, satisfactory characteristics could be provided if the length of the primary line and secondary line were set to approximately one-quarter wavelength of a used frequency band, but such a length would result in extremely long lines, so that this embodiment employs the primary line and secondary line, both of which have a shorter line length than the one-quarter wavelength of the used frequency band.

The coupler 11 of this embodiment is fabricated in a manner similar to the coupler according to the comparative example, by forming a laminated board which comprises a plurality of conductor layers and has a rectangular shape, as viewed in plan, with the primary line and secondary line, and the respective ports on internal wiring layers (conductor layers) of the laminated board.

FIGS. 2A-2K show the respective layers of the laminated board. As shown in these figures, the laminated board has six conductor layers from a first layer through a sixth layer, where the primary line 12, secondary line 13, and respective ports P1-P4 are formed on the third and fourth layers.

Figure 2A:
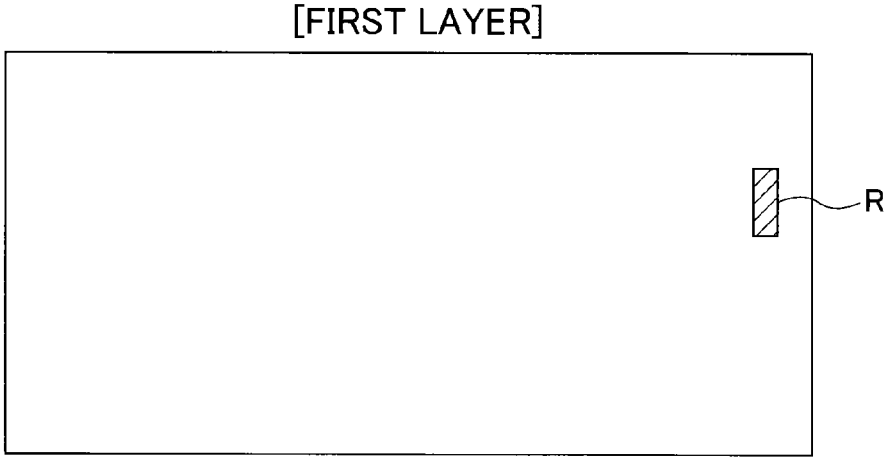
FIG. 2A is a plan view showing a first layer of a laminated board which constitutes the coupler according to the first embodiment.
Figure 2B:
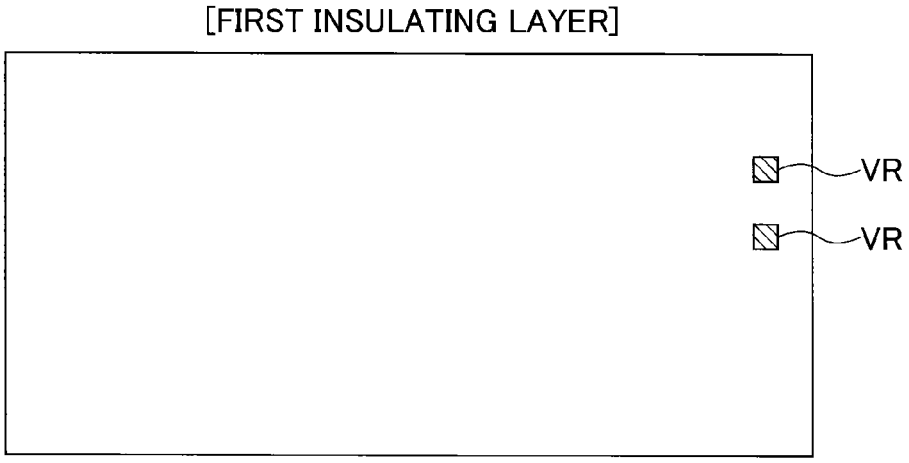
FIG. 2B is a plan view showing a first insulating layer of the laminated board which constitutes the coupler according to the first embodiment.
Figure 2C:
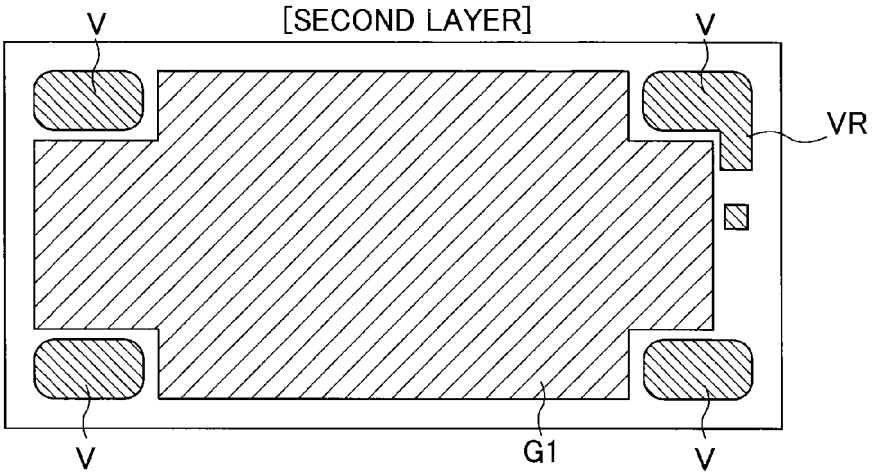
FIG. 2C is a plan view showing a second layer of the laminated board which constitutes the coupler according to the first embodiment.
Figure 2D:
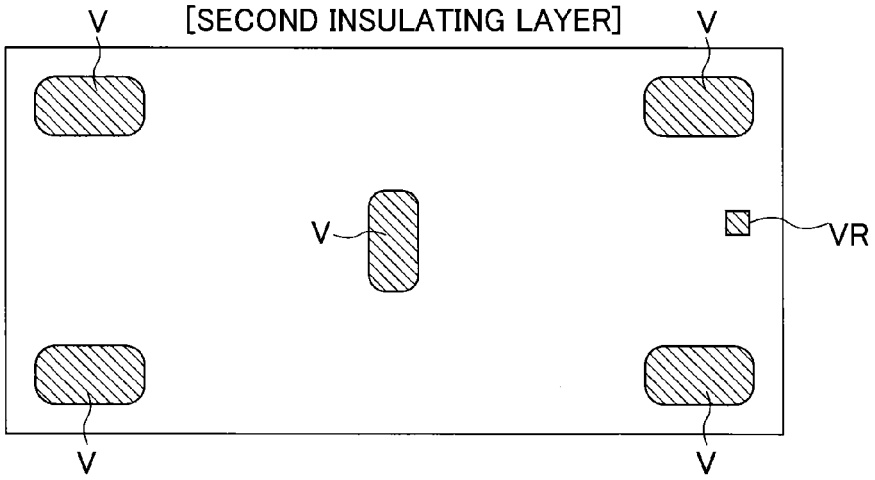
FIG. 2D is a plan view showing a second insulating layer of the laminated board which constitutes the coupler according to the first embodiment.
Figure 2E:
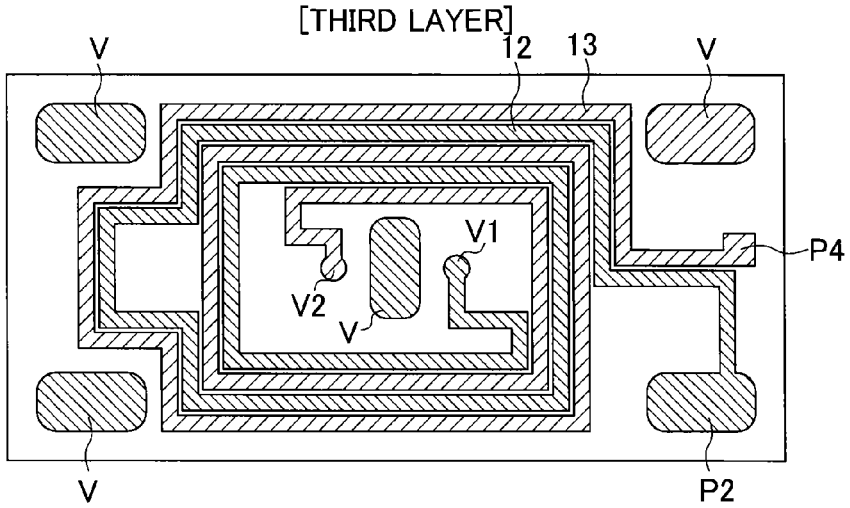
FIG. 2E is a plan view showing a third layer of the laminated board which constitutes the coupler according to the first embodiment.
Figure 2F:
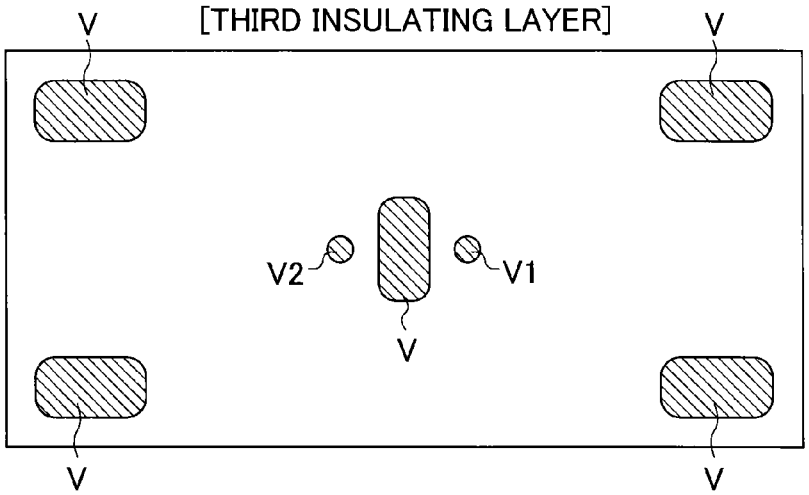
FIG. 2F is a plan view showing a third insulating layer of the laminated board which constitutes the coupler according to the first embodiment.
Figure 2G:
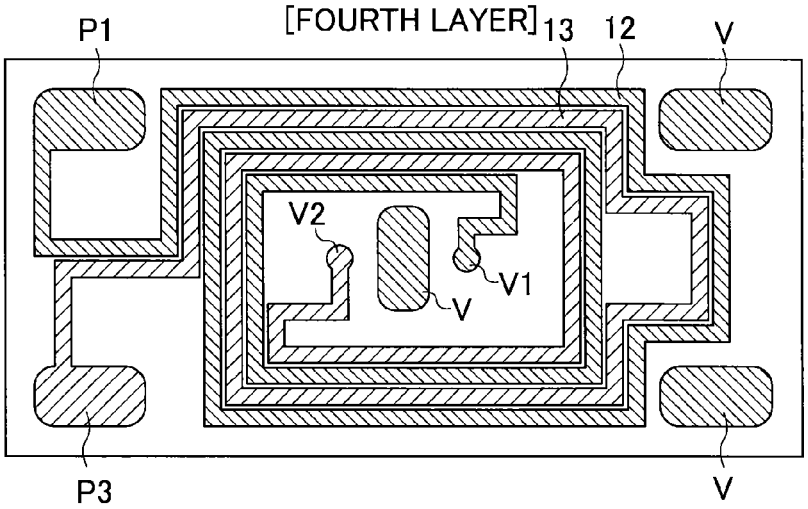
FIG. 2G is a plan view showing a fourth layer of the laminated board which constitutes the coupler according to the first embodiment.
Figure 2H:
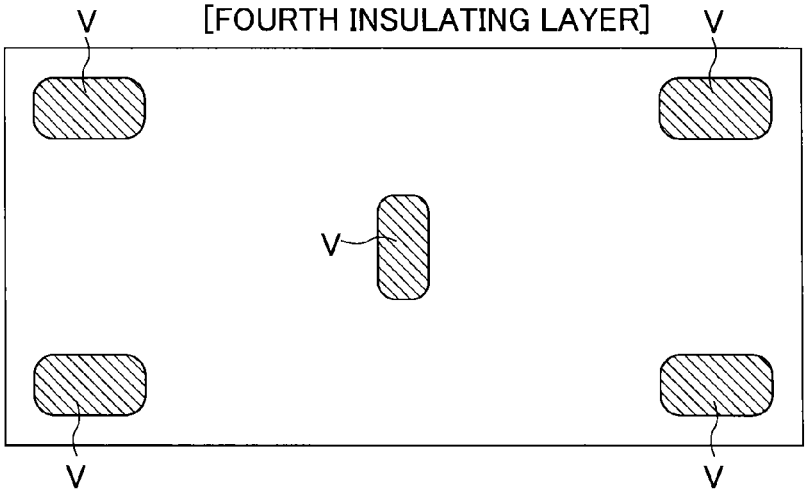
FIG. 2H is a plan view showing a fourth insulating layer of the laminated board which constitutes the coupler according to the first embodiment.

Specifically, as shown in FIG. 2G, P1 is placed near the upper left corner of the fourth layer, and P3 is placed near the lower left corner of the same, respectively. The primary line 12 is extended from P1 toward P3, while the secondary line 13 is extended from P3 toward P1, to bring both lines 12, 13 in close proximity to each other. Then, spiral patterns are formed from a peripheral area of the board to the center of the board, such that both lines 12, 13 run in parallel (extend in parallel) with a certain spacing therebetween. The spiral lines in a central area of the board are such that the primary line 12 and secondary line 13 are alternately wound with a certain narrow spacing interposed therebetween, thus resulting in intra-layer coupling of the primary line 12 and the secondary line 13.

In the central area of the board, the primary line 12 is connected to a via V1, and the secondary line 13 is connected to a via V2, respectively. These vias V1, V2 extend from the fourth layer (FIG. 2G) through a third insulating layer (FIG. 2F) up to the third layer (FIG. 2E). As shown in FIG. 2E, on the third layer, the primary line 12 is connected to the via V1, and the secondary line 13 is connected to the via V2, respectively. The primary line 12 and secondary line 13 on the third layer are formed in a spiral pattern from the center of the board toward a peripheral area of the board, as opposed to the primary line 12 and secondary line 13 on the fourth layer. Again on the third layer, the primary line 12 and secondary line 13 run in parallel such that they are spirally wound with a certain spacing interposed therebetween. The secondary line 13 is connected to P4 placed near an upper right corner of the third layer, and the primary line 12 is connected to P2 placed near the lower right corner of the third layer, respectively.

In this regard, P4 is formed closer to the center in the vertical direction of FIG. 2E, as compared with the position at which an external connection terminal T4, later described, is formed for P4, in order to connect the terminal resistor R between P4 and the external connection terminal T4 in this embodiment. However, when the terminal resistor R is not used, P4 may be disposed at a position immediately above the external connection terminal T4 (position at which a via V is formed near the upper right corner of the board in FIG. 2E) on the bottom of the board, in a manner similar to the other ports P1-P3.

Again on the third layer, the spiral lines in the central area of the board are similar to those on the fourth layer in that the primary line 12 and secondary line 13 are spirally wound with a certain narrow spacing interposed therebetween. However, when viewed in plan, the primary line 12 on the third layer is disposed to overlap with the secondary line 13 on the fourth layer, while the secondary line 13 on the third layer is disposed to overlap with the primary line 12 on the fourth layer. Accordingly, these spiral lines form intra-layer coupling, and simultaneously form inter-layer coupling between the third layer and the fourth layer as well.

Figure 3:
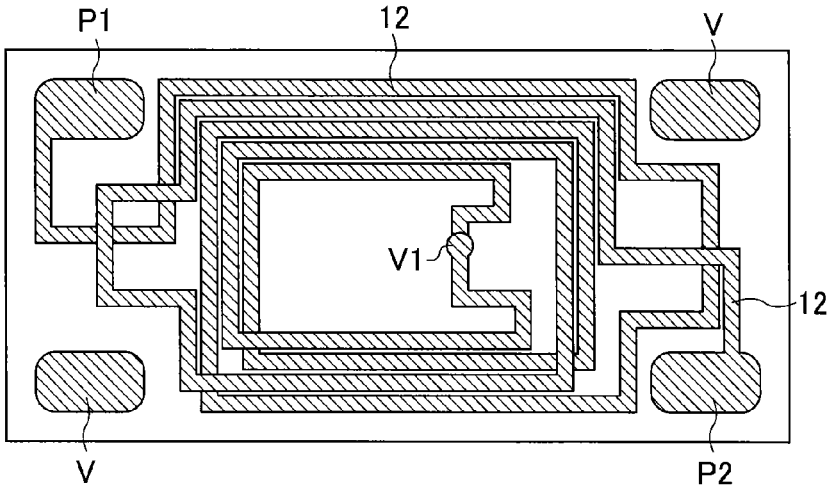
FIG. 3 is a plan view showing a first line (primary line) of the coupler according to the first embodiment.

By forming such double coupling, the coupling can be enhanced between the primary line 12 and the secondary line 13. For clarity, FIG. 3 shows the primary line 12 in a see-through representation as viewed in plan, and FIG. 4 similarly shows the secondary line 13 in a see-through representation as viewed in plan, respectively. FIG. 5 in turn shows portions of the primary line 12 and secondary line 13 which overlap with each other to develop the inter-layer coupling (hatched portions in FIG. 5). As later described with reference to a variety of line patterns, this embodiment comprises a double coupling space C4 in which intra-layer coupled lines are mutually involved in the inter-layer coupling as well, i.e., the double coupling space C4 in which the secondary line 13 and primary line 12 on the second conductor layer (third layer in this embodiment) are inter-layer coupled to both lines (primary line 12 and secondary line 13), respectively, included in the intra-layer coupling on the first conductor layer (fourth layer in this embodiment).

Also, in this embodiment, an insulating layer (third insulating layer) is interposed between the conductor layers (third and fourth layers) which are involved in the inter-layer coupling. Alternatively, however, the inter-layer coupling may be implemented between conductor layers which adjoin in the direction of lamination (for example, without intervention of another insulating layer such as that between the third layer and the fourth layer), or one or more conductor layers may be interposed, depending on the thickness and the like of the insulating layer interposed between respective conductor layers.

Figure 2I:
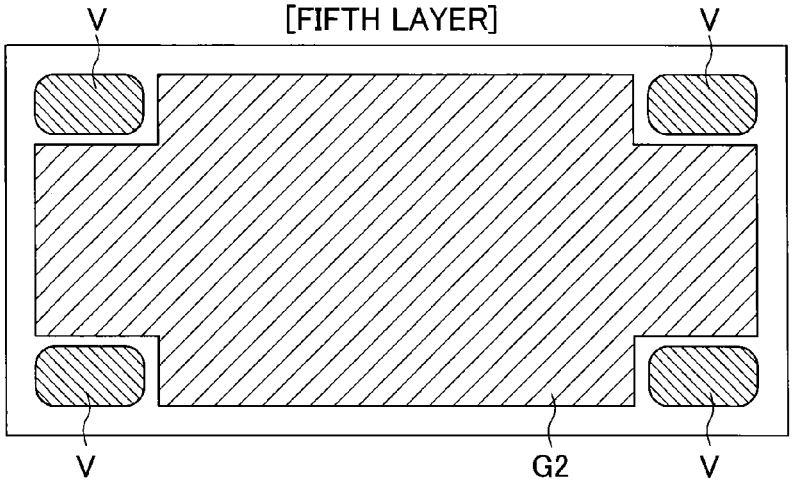
FIG. 2I is a plan view showing a fifth layer of the laminated board which constitutes the coupler according to the first embodiment.
Figure 2J:
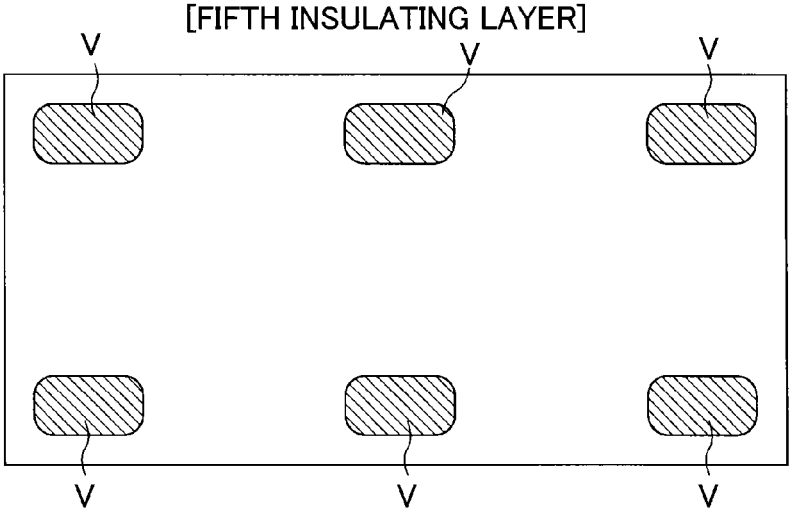
FIG. 2J is a plan view showing a fifth insulating layer of the laminated board which constitutes the coupler according to the first embodiment.

Further, as shown in FIGS. 2C and 2I, ground electrodes G1, G2 are provided on the second and fifth layers to extend substantially entirely on these conductor layers so as to sandwich the primary line 12 and secondary line 13 therebetween. These ground electrodes G1, G2 are intended to prevent the coupler (coupling lines) of this embodiment from being affected by other parts and members possibly disposed in close proximity to the coupler when it is mounted.

Figure 2K:
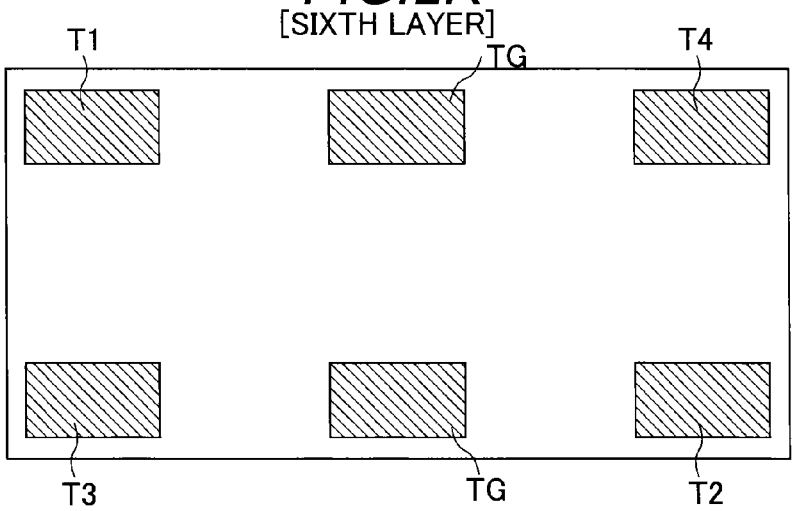
FIG. 2K is a plan view showing a sixth layer of the laminated board which constitutes the coupler according to the first embodiment.

Also, as shown in FIG. 2K, the coupler comprises terminals T1, T2, T3, T4, TG for external connections on the sixth layer, i.e., the bottom of the board. Specifically, the external connection terminals T1-T3 are disposed to correspond to the positions at which the respective ports P1-P3 are disposed (positions beneath these P1-P3). Then, through vias V which extend substantially perpendicularly through the laminated board, these external connection terminals T1, T2, T3 are connected to the ports P1, P2, P3, respectively. Also, the port P4 placed on the third layer is connected to the external connection terminal T4 on the bottom of the board, where a terminal resistor R is inserted between these P4 and T4. Specifically, one end of the terminal resistor R formed on the first layer (FIG. 2A) is connected to the port P4 formed on the third layer (FIG. 2E) through a via VR which extends through the first insulating layer (FIG. 2B), second layer (FIG. 2C), and second insulating layer (FIG. 2D), while the other end of the terminal resistor R is connected to the external connection terminal T4 through a via VR which extends through the first insulating layer and through a via V which extends substantially perpendicularly through the laminated board.

The external connection terminals TG placed near the centers of both horizontal sides are provided for connection to the ground electrodes G1, G2, and these ground terminals TG are connected to the ground electrode G2 on the fifth layer through vias V. The ground electrode G1 on the second layer, in turn, is connected to the ground electrode G2 on the fifth layer through a via formed in a central area of the board to perpendicularly extend through the second insulating layer, third layer, third insulating layer, fourth layer, and fourth insulating layer (FIGS. 2D-2H), and is connected to the ground terminals TG through the ground electrode G2 on the fifth layer.

FIGS. 6A-6D are graphs which represent characteristics (reflection loss, insertion loss, coupling degree, isolation, and phase difference) of the coupler according to this embodiment. As is apparent from these graphs, according to this embodiment, more satisfactory characteristics can be achieved as compared with the coupler according to the comparative example (FIGS. 36A-36D).

Moreover, while the coupler of the comparative example requires eight conductor layers (a total of four layers for forming the coupling lines, i.e., the second and third layers and the fifth and sixth layers), this embodiment requires only five layers (except for the first layer for forming the terminal resistor R) (a total of two layers for forming the coupling lines, i.e., the third and fourth layers), thus making it possible to substantially reduce the number of laminated layers. Consequently, the functional layers can be implemented in a size of 1.0 mm long, 0.5 mm wide, and 0.082 mm high (thick), for example, for a 2.6-GHz band.

Further, FIGS. 7A-34 show a variety of patterns for the coupling lines (primary line 12 and secondary line 13) which are designed based on the present invention as a second through an eighth embodiment. These embodiments can be generally classified into three aspects.

Second Embodiment

A first aspect separately implements intra-layer coupling (this coupling and associated zone are hereinafter labeled "C1") and inter-layer coupling (this coupling and associated space are hereinafter labeled "C2"), but does not implement double-coupling.

Figure 7A:
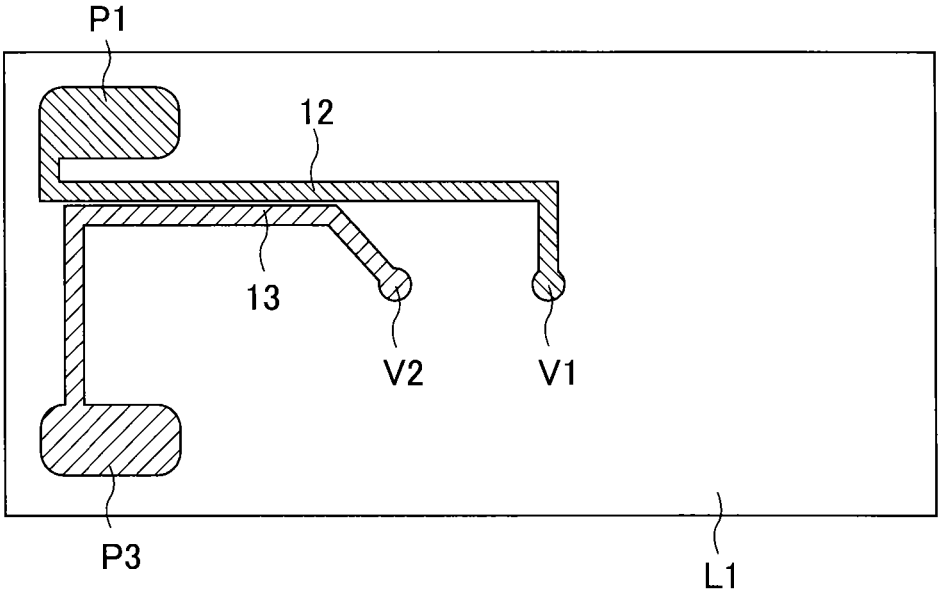
FIG. 7A is a plan view showing a first conductor layer of a coupler according to a second embodiment of the present invention.
Figure 7B:
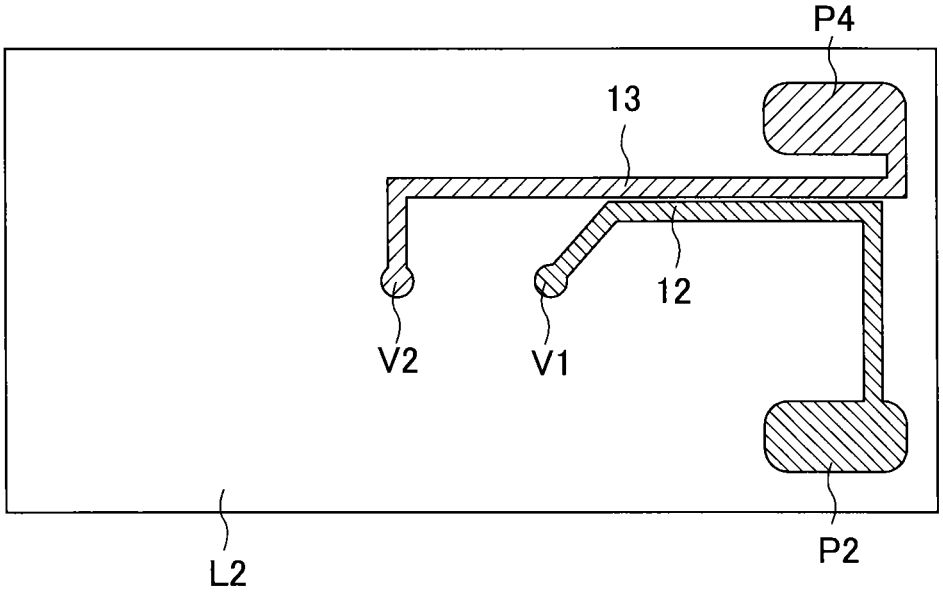
FIG. 7B is a plan view showing a second conductor layer of the coupler according to the second embodiment.

FIGS. 7A through 10 show a second embodiment implemented in accordance with the first aspect. As shown in FIG. 7A, in this embodiment, ports P1 and P3 are disposed on a first conductor layer, which may be any of conductor layers within a laminated board. A primary line 12 and secondary line 13 are extended from these ports P1, P3, respectively. Both lines 12, 13 are routed in close proximity to run in parallel, thereby developing the intra-layer coupling. Then, the primary line 12 is electrically connected to a second conductor layer, which may be another conductor layer within the laminated board, through a via V1, while the secondary line 13 is electrically connected to the second conductor layer through a via V2. The second conductor layer has been provided with ports P2, P4, and the via V1 is connected to P2 with a conductor line to serve as the primary line 12 which continues from the first conductor layer, while the via V2 is connected to P4 with a conductor line to serve as the secondary line 13 which continues from the first conductor layer. Likewise, on the second conductor layer, an intermediate section of the primary line 12, except for the end connected to the via V1 and the end connected to P2, and an intermediate section of the secondary line 13, except for the end connected to the via V2 and the end connected to P4, are brought in close proximity to each other to develop the intra-layer coupling, in a manner similar to the first conductor layer.

Figure 4:
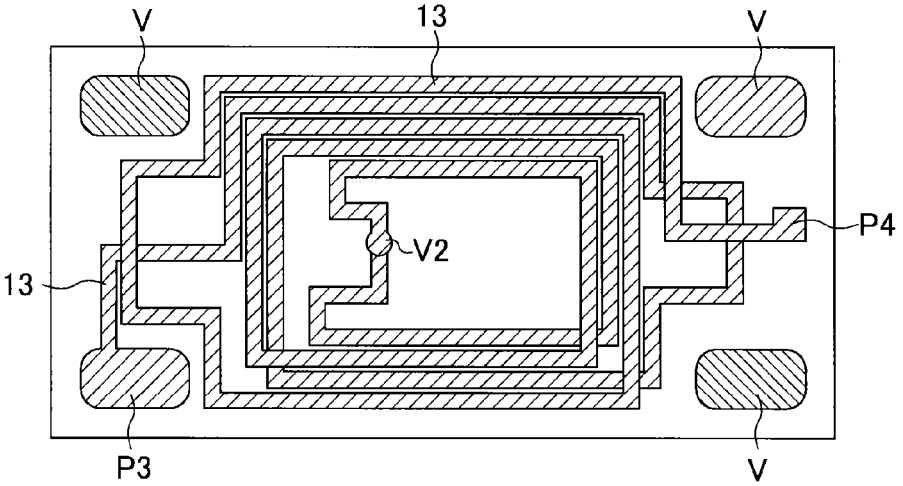
FIG. 4 is a plan view showing a second line (secondary line) of the coupler according to the first embodiment.
Figure 5:
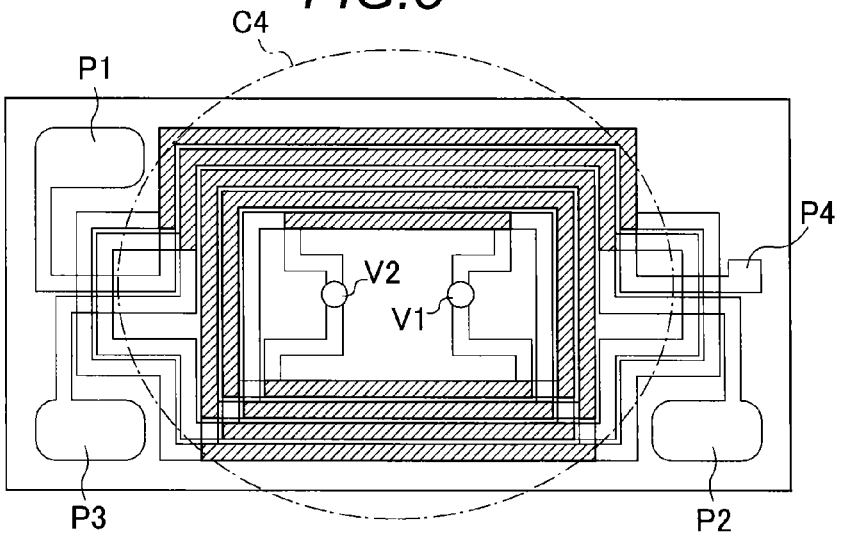
FIG. 5 is a plan view showing the placement of the first line (primary line) and second line (secondary line) of the coupler according to the first embodiment in a see-through representation.
Figure 6A:
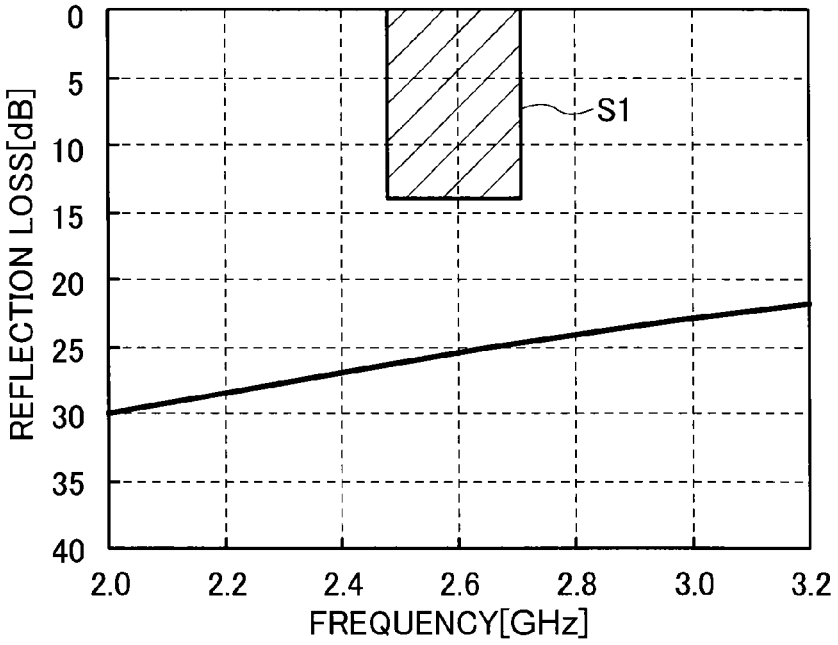
FIG. 6A is a graph representing a reflection loss of the coupler according to the first embodiment.
Figure 6B:
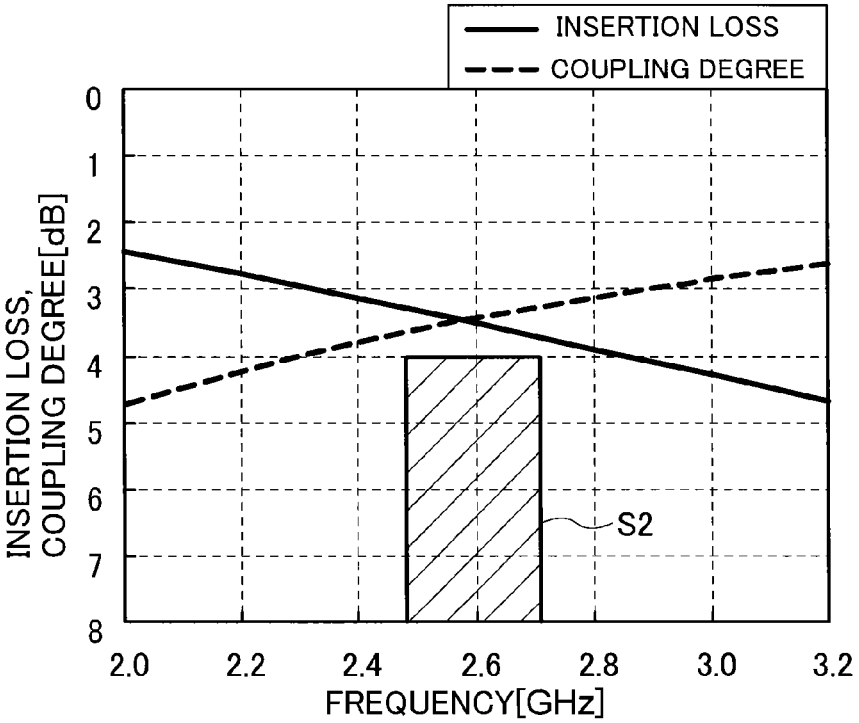
FIG. 6B is a graph representing an insertion loss and a coupling degree of the coupler according to the first embodiment.
Figure 6C:
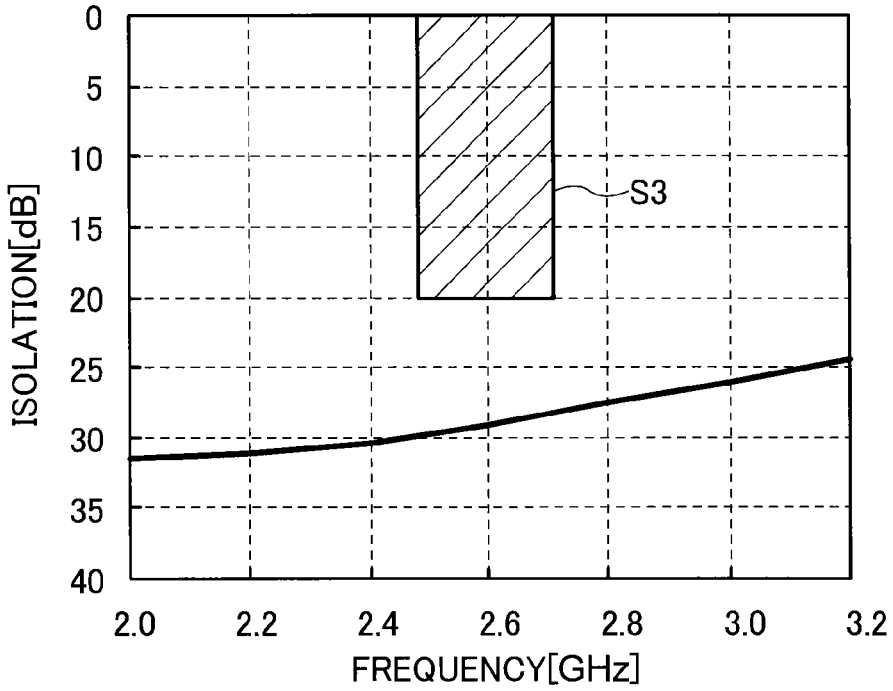
FIG. 6C is a graph representing isolation of the coupler according to the first embodiment.
Figure 6D:
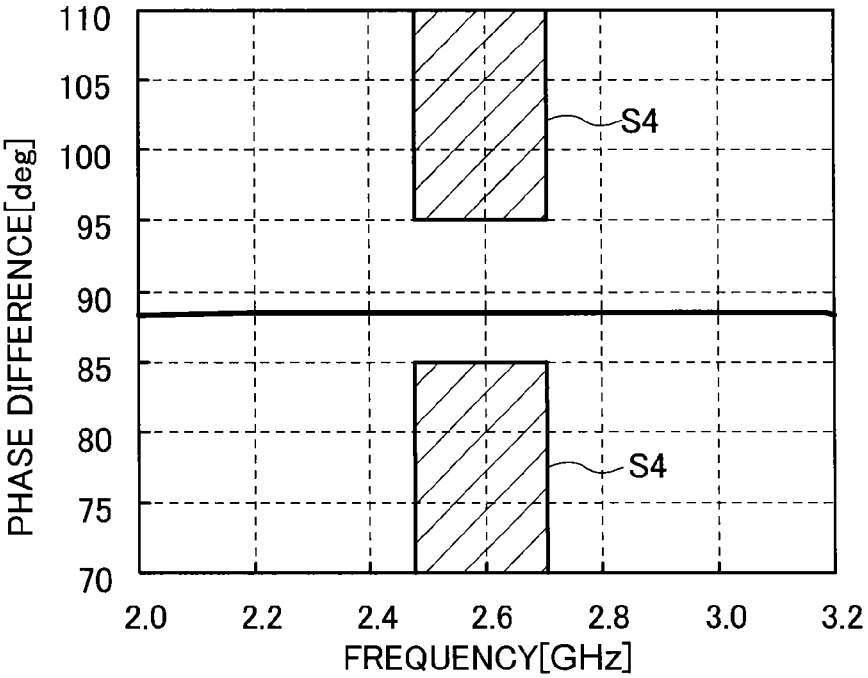
FIG. 6D is a graph representing a phase difference of the coupler according to the first embodiment.
Figure 8:
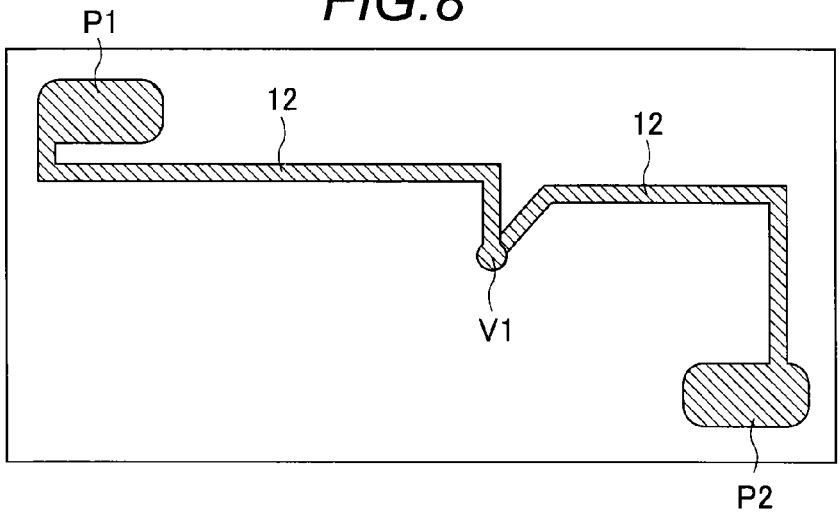
FIG. 8 is a plan view showing a first line of the coupler according to the second embodiment.
Figure 9:
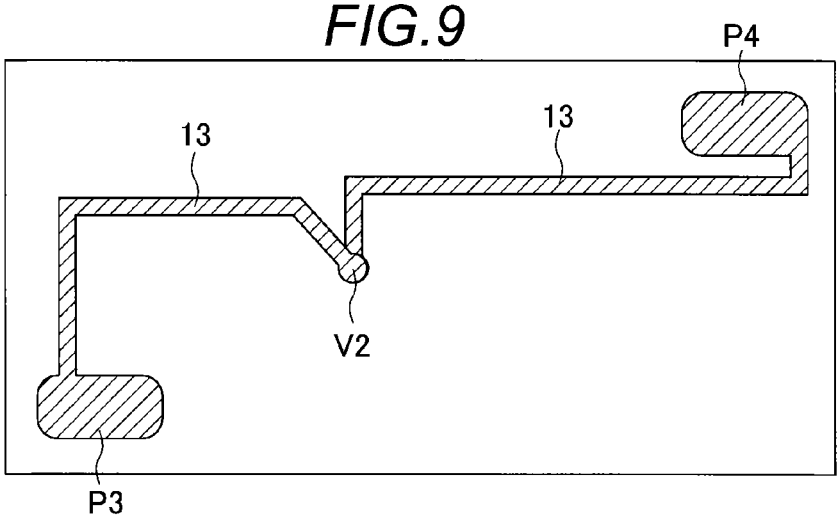
FIG. 9 is a plan view showing a second line of the coupler according to the second embodiment.
Figure 10:
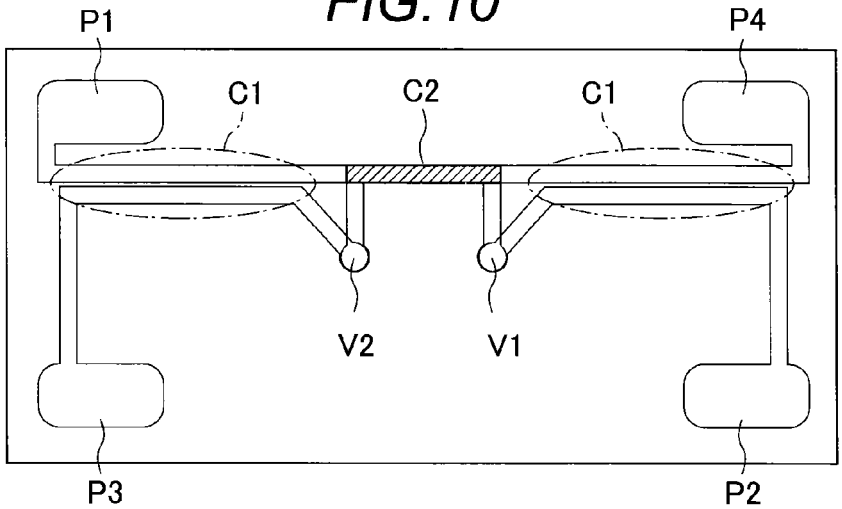
FIG. 10 is a plan view showing the placement of the first line and second line of the coupler according to the second embodiment in a see-through representation.
Figure 11A:
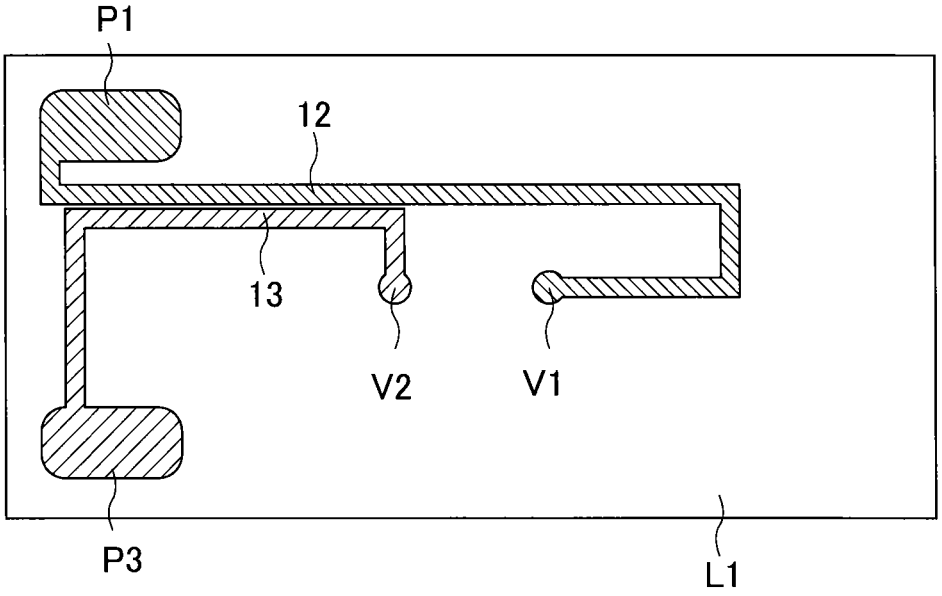
FIG. 11A is a plan view showing a first conductor layer of a coupler according to a third embodiment of the present invention.
Figure 11B:
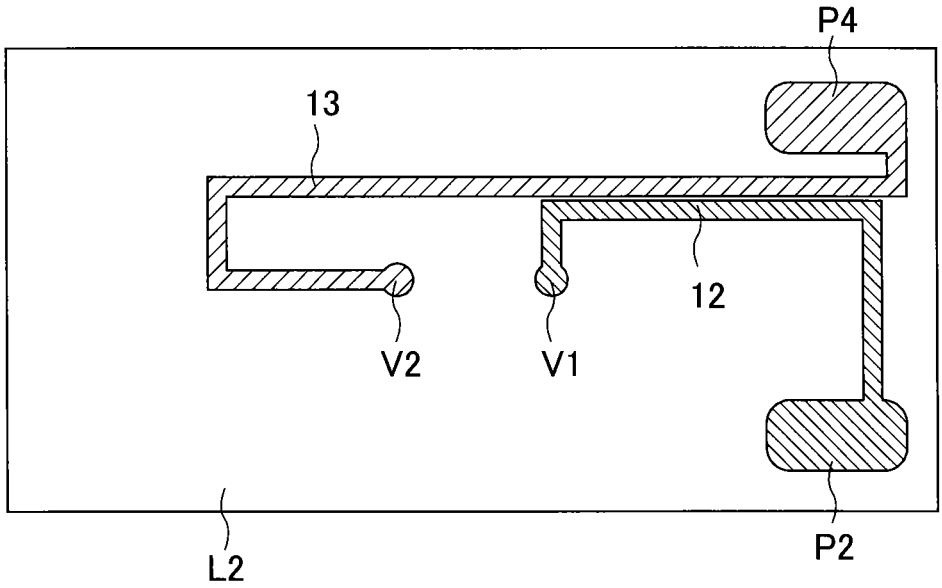
FIG. 11B is a plan view showing a second conductor layer of the coupler according to the third embodiment.
Figure 12:
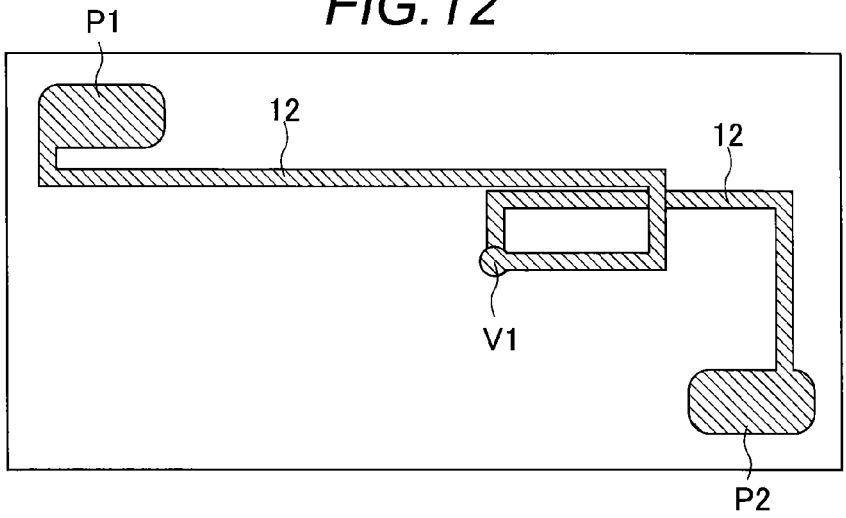
FIG. 12 is a plan view showing a first line of the coupler according to the third embodiment.
Figure 13:
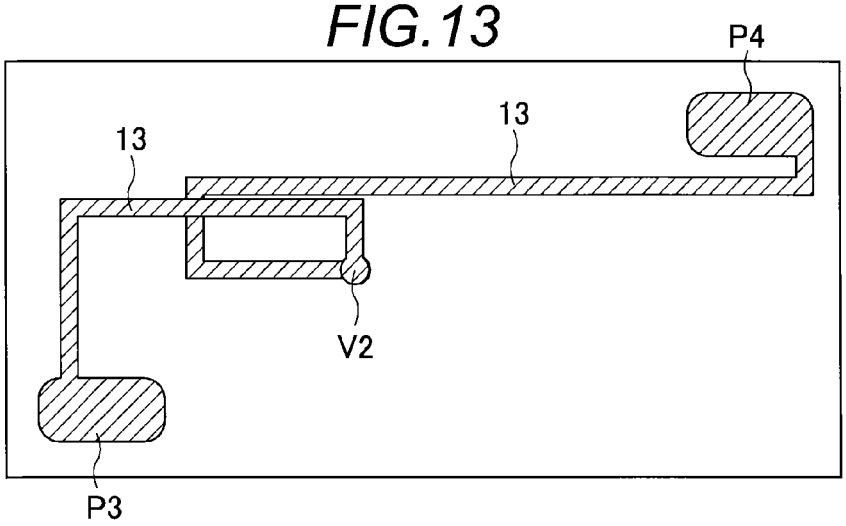
FIG. 13 is a plan view showing a second line of the coupler according to the third embodiment.
Figure 14:
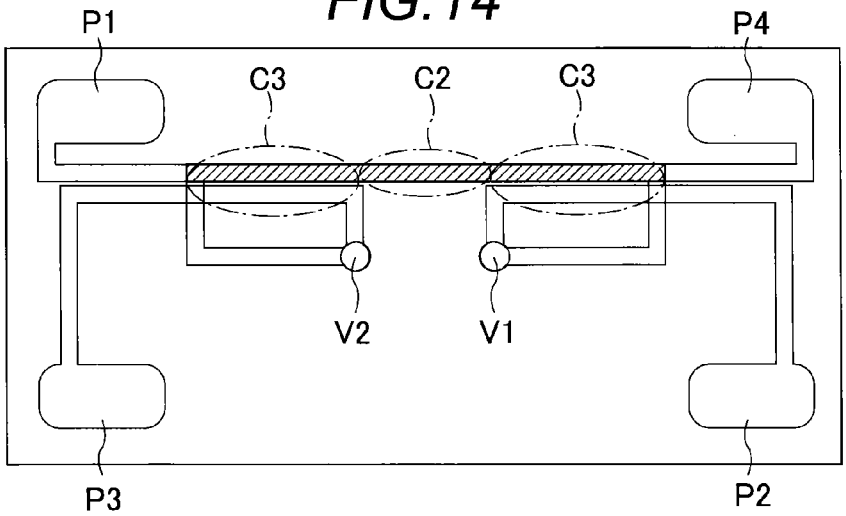
FIG. 14 is a plan view showing the placement of the first line and second line of the coupler according to the third embodiment in a see-through representation.
Figure 15A:
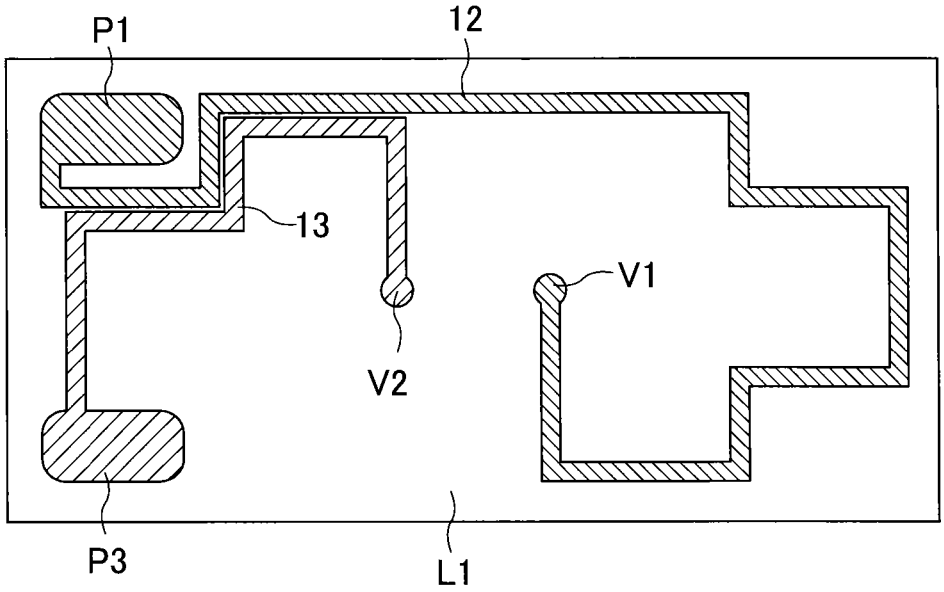
FIG. 15A is a plan view showing a first conductor layer of a coupler according to a fourth embodiment of the present invention.
Figure 15B:
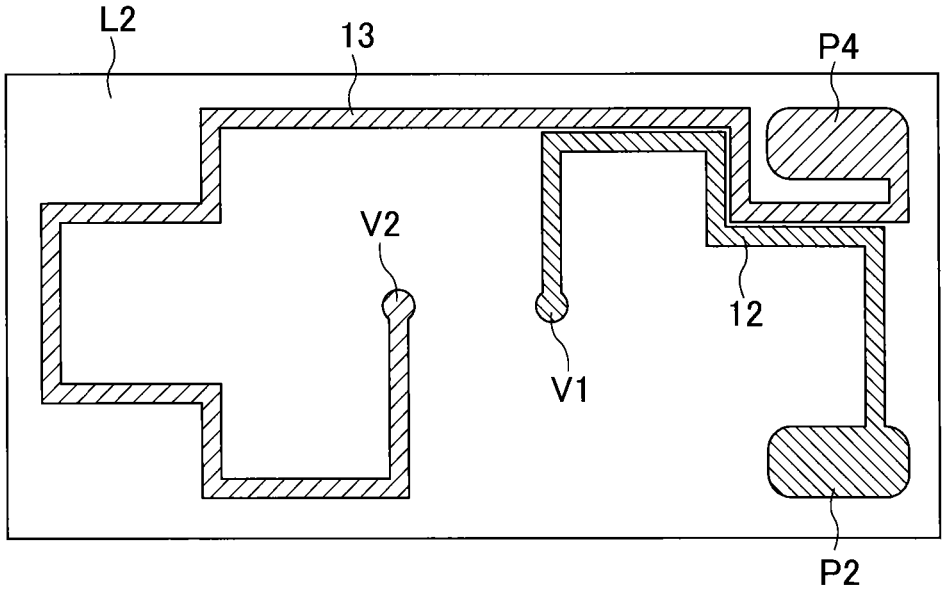
FIG. 15B is a plan view showing a second conductor layer of the coupler according to the fourth embodiment.
Figure 16:
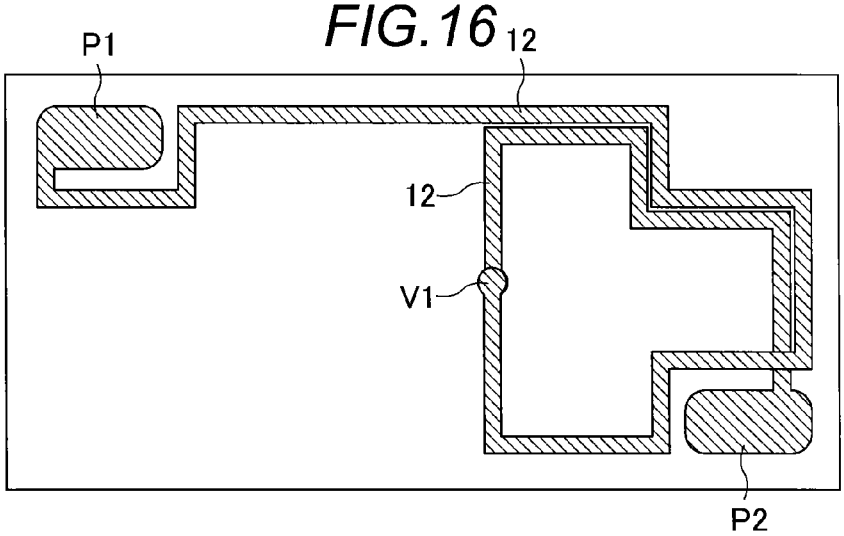
FIG. 16 is a plan view showing a first line of the coupler according to the fourth embodiment.
Figure 17:
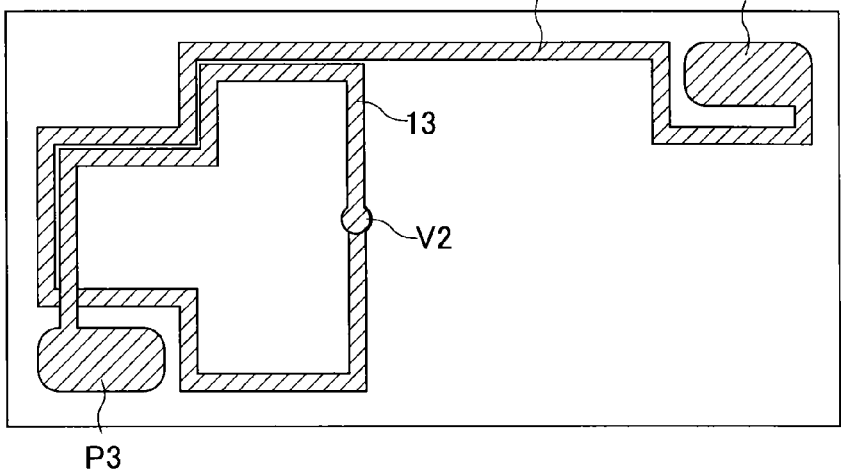
FIG. 17 is a plan view showing a second line of the coupler according to the fourth embodiment.
Figure 18:
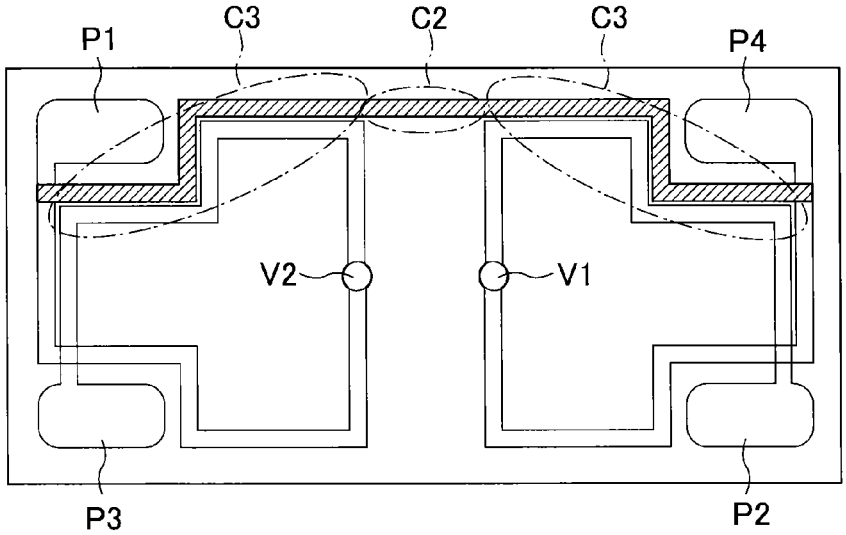
FIG. 18 is a plan view showing the placement of the first line and second line of the coupler according to the fourth embodiment in a see-through representation.
Figure 19A:
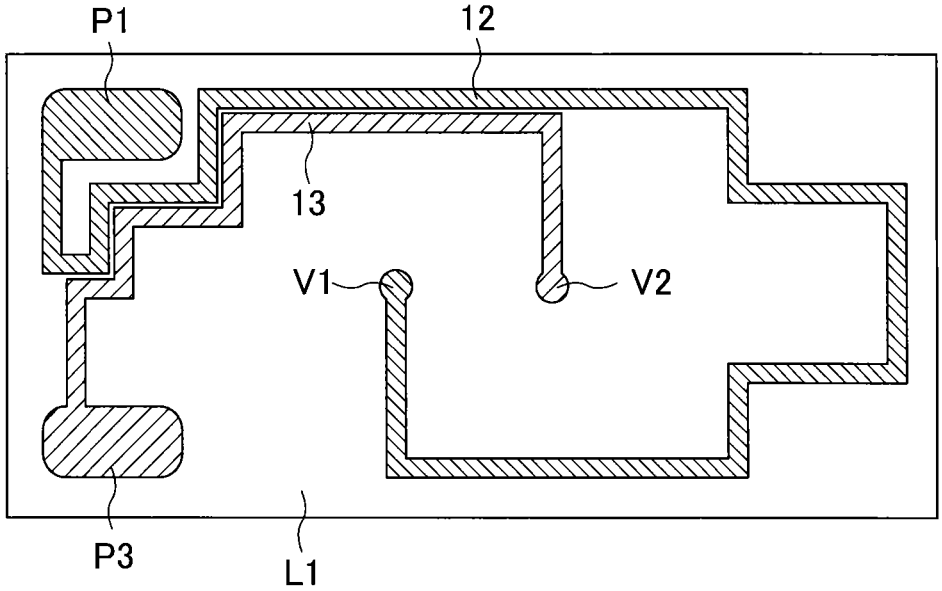
FIG. 19A is a plan view showing a first conductor layer of a coupler according to a fifth embodiment of the present invention.
Figure 19B:
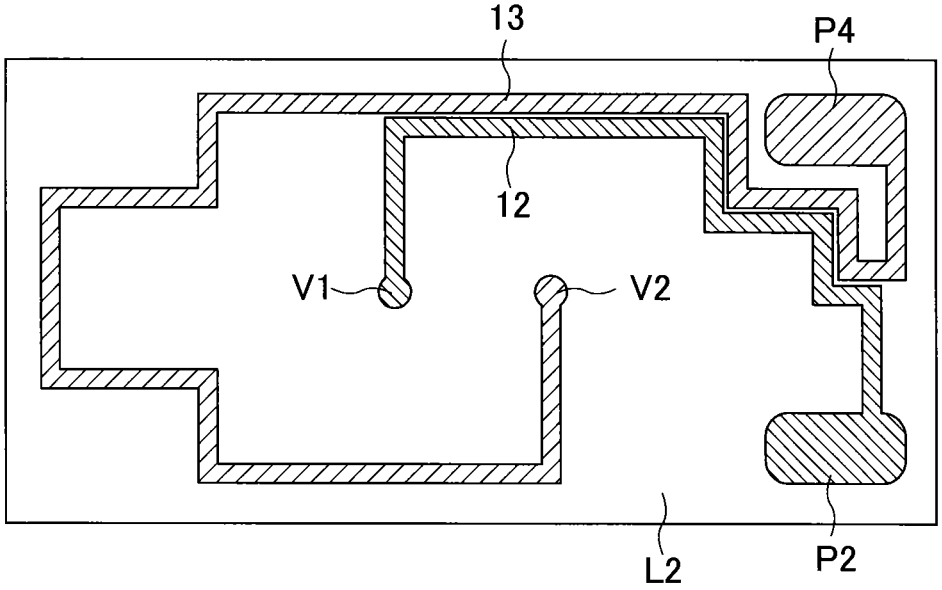
FIG. 19B is a plan view showing a second conductor layer of the coupler according to the fifth embodiment.
Figure 20:
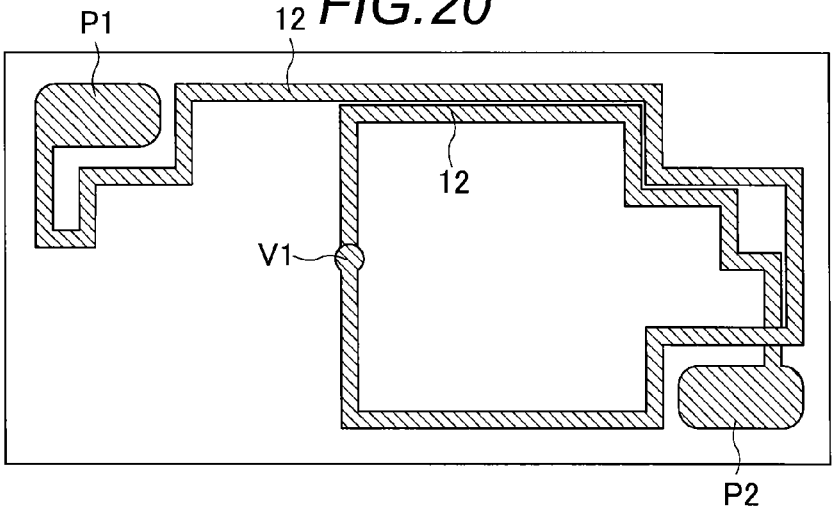
FIG. 20 is a plan view showing a first line of the coupler according to the fifth embodiment.
Figure 21:
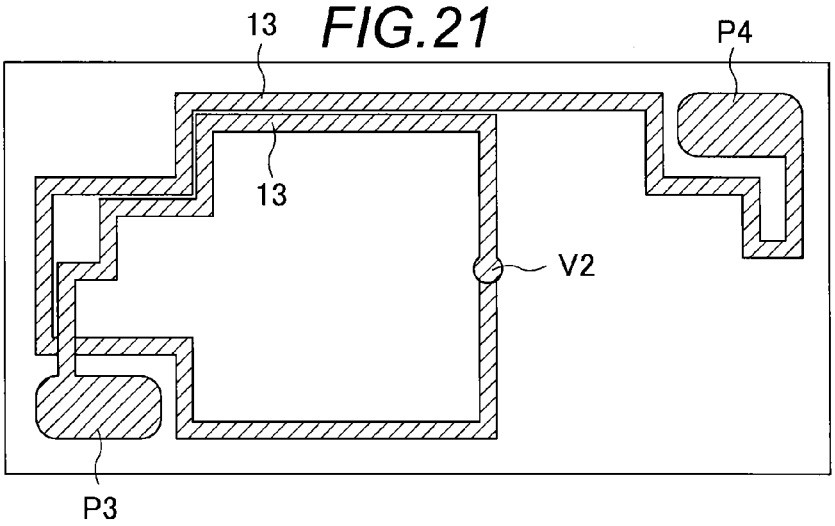
FIG. 21 is a plan view showing a second line of the coupler according to the fifth embodiment.
Figure 22:
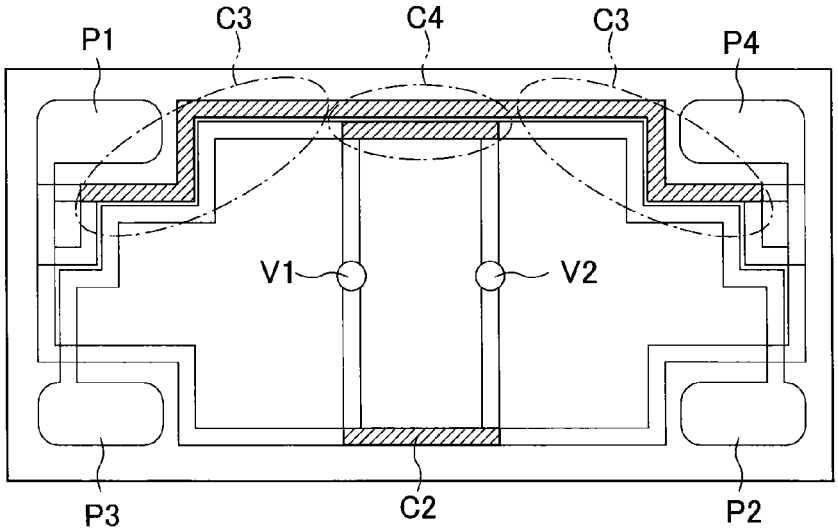
FIG. 22 is a diagram showing the placement of the first line and second line of the coupler according to the fifth embodiment in a see-through representation.
Figure 23A:
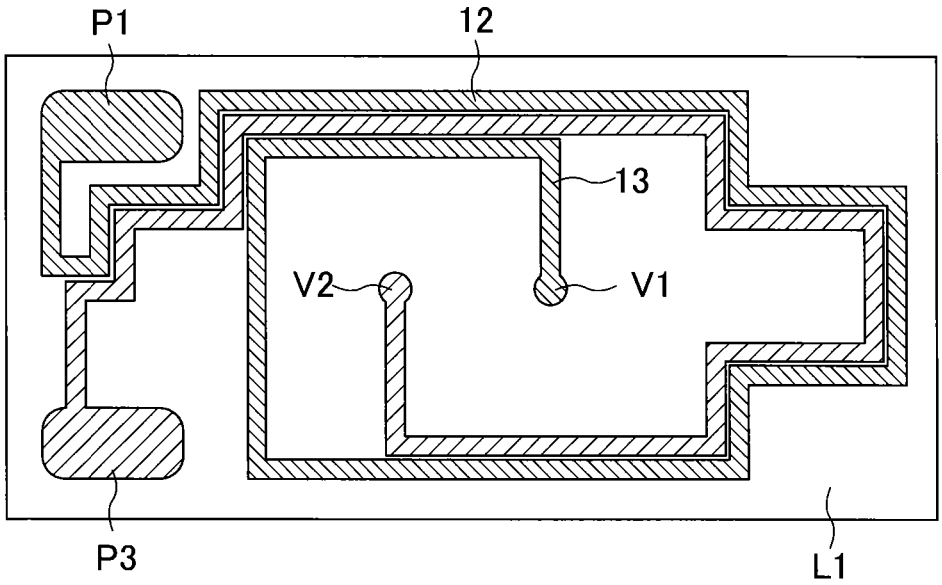
FIG. 23A is a plan view showing a first conductor layer of a coupler according to a sixth embodiment of the present invention.
Figure 23B:
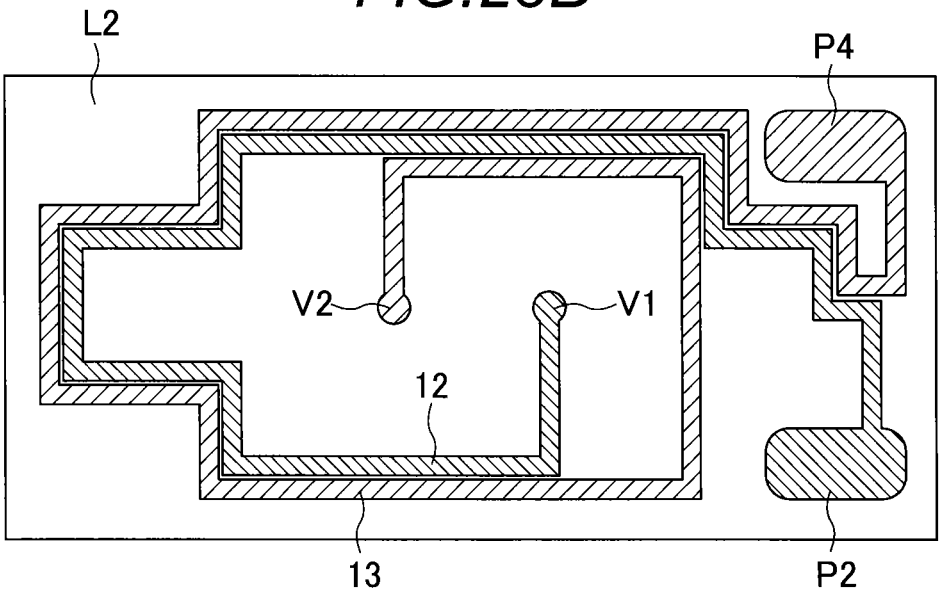
FIG. 23B is a plan view showing a second conductor layer of the coupler according to the sixth embodiment.
Figure 24:
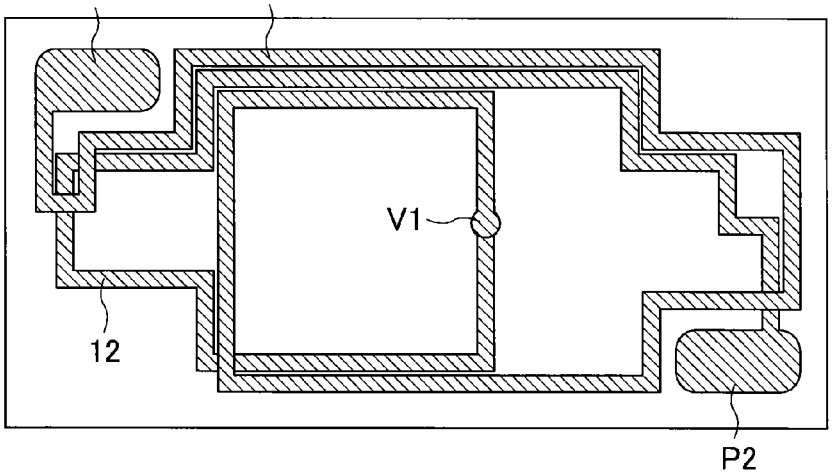
FIG. 24 is a plan view showing a first line of the coupler according to the sixth embodiment.
Figure 25:
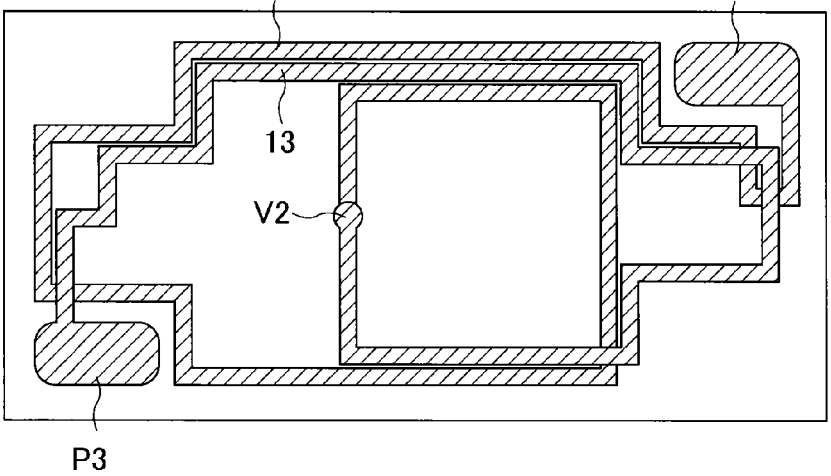
FIG. 25 is a plan view showing a second line of the coupler according to the sixth embodiment.
Figure 26:
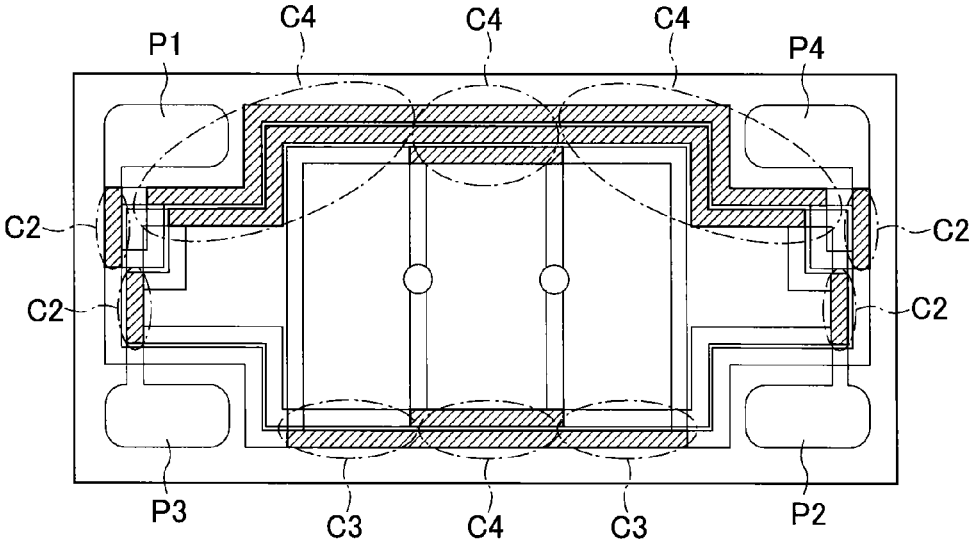
FIG. 26 is a diagram showing the placement of the first line and second line of the coupler according to the sixth embodiment in a see-through representation.
Figure 27A:
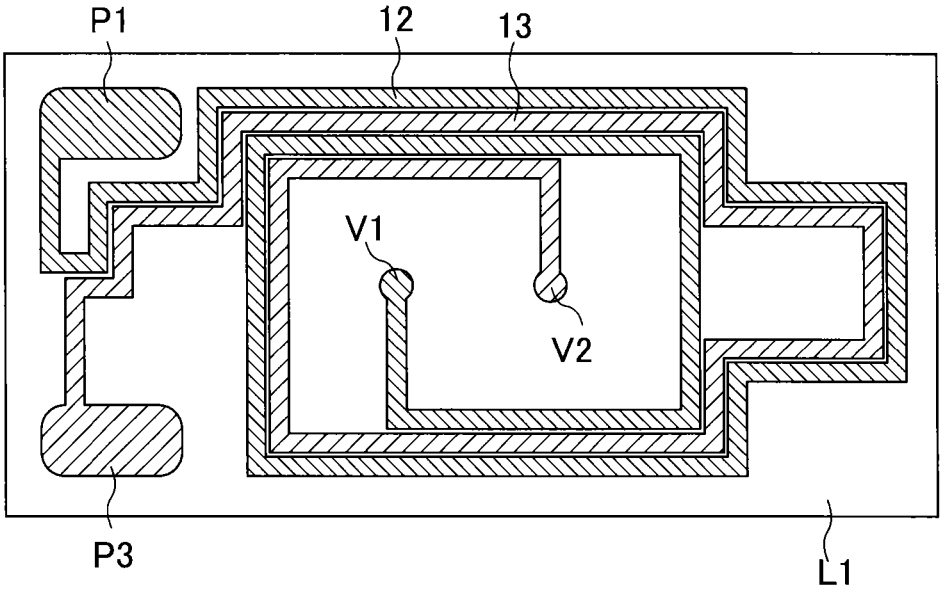
FIG. 27A is a plan view showing a first conductor layer of a coupler according to a seventh embodiment of the present invention.
Figure 27B:
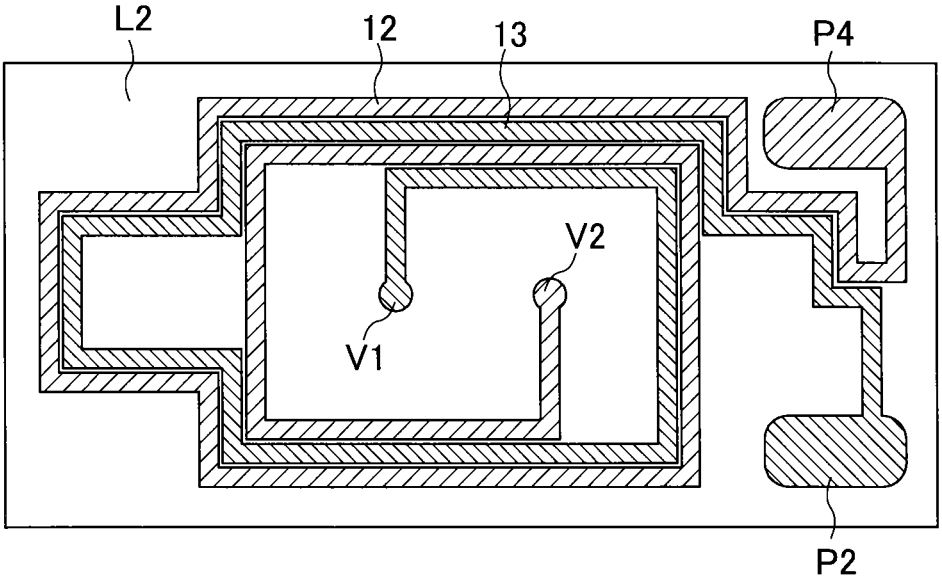
FIG. 27B is a plan view showing a second conductor layer of the coupler according to the seventh embodiment.
Figure 28:
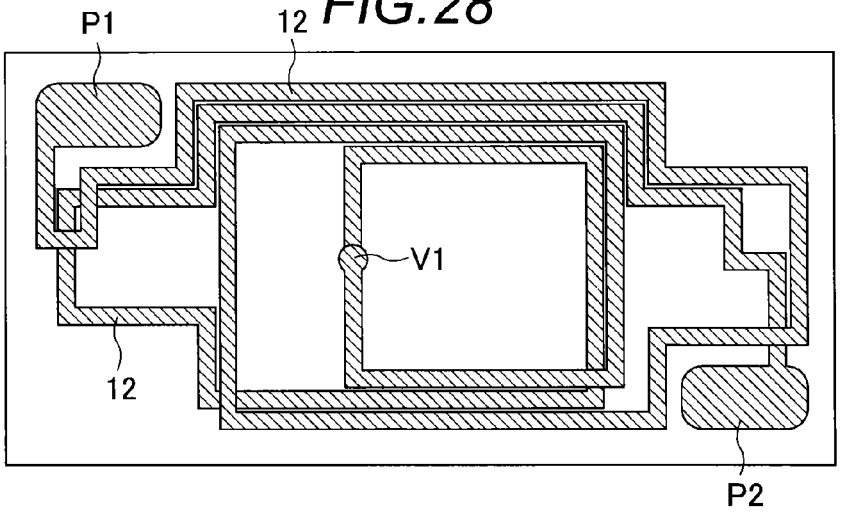
FIG. 28 is a plan view showing a first line of the coupler according to the seventh embodiment.
Figure 29:
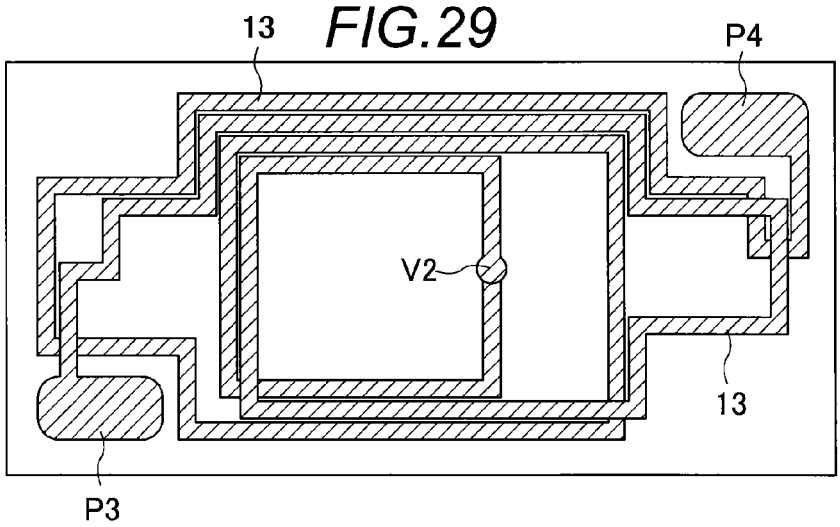
FIG. 29 is a plan view showing a second line of the coupler according to the seventh embodiment.
Figure 30:
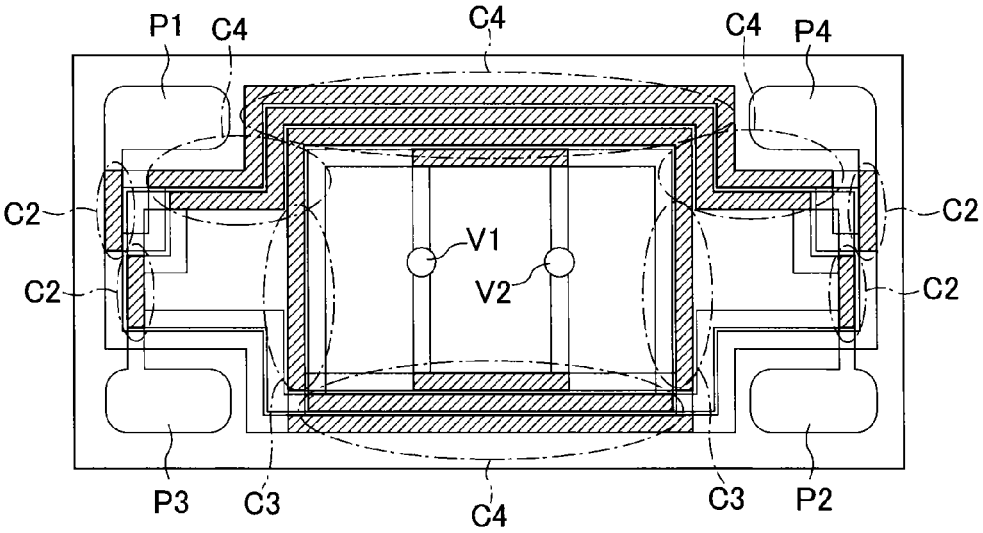
FIG. 30 is a diagram showing the placement of the first line and second line of the coupler according to the seventh embodiment in a see-through representation.
Figure 31A:
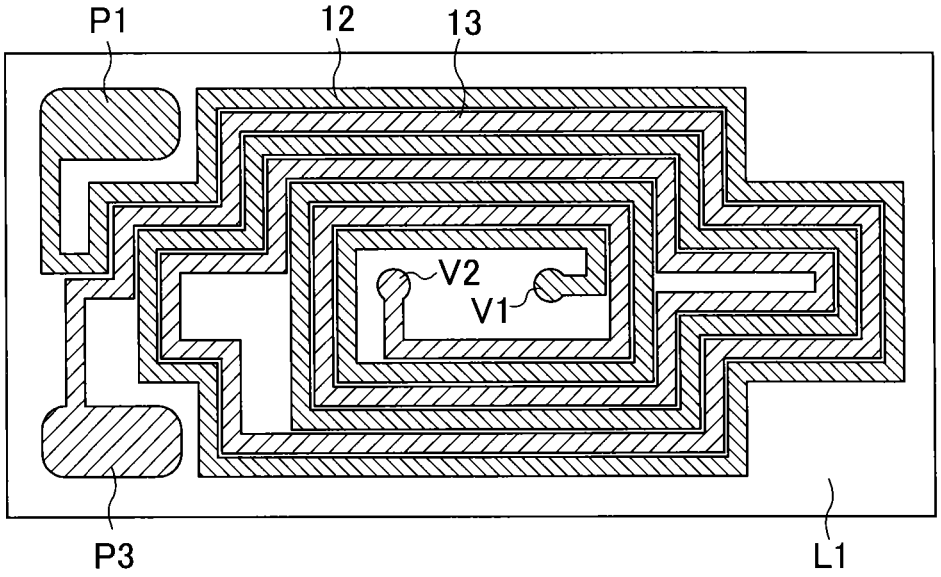
FIG. 31A is a plan view showing a first conductor layer of a coupler according to an eighth embodiment of the present invention.
Figure 31B:
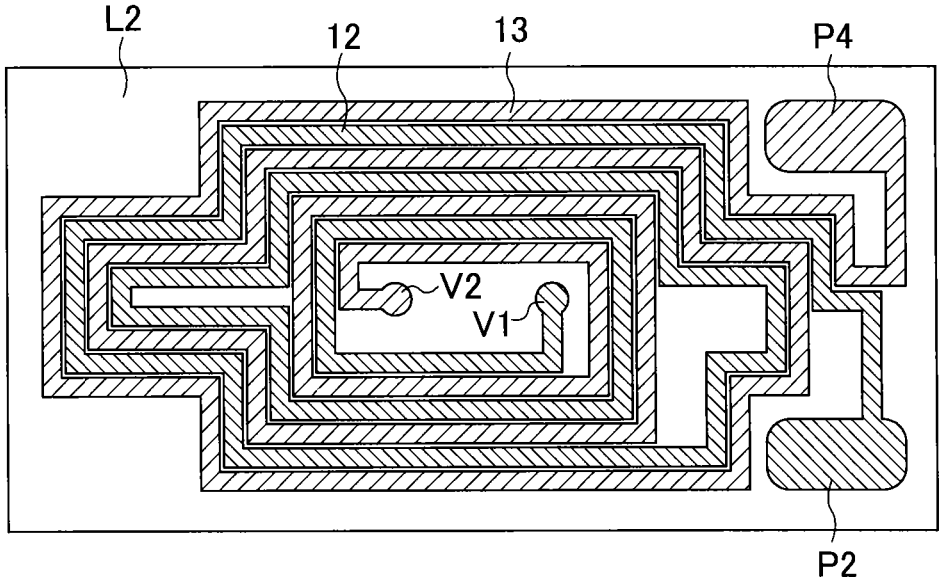
FIG. 31B is a plan view showing a second conductor layer of the coupler according to the eighth embodiment.
Figure 32:
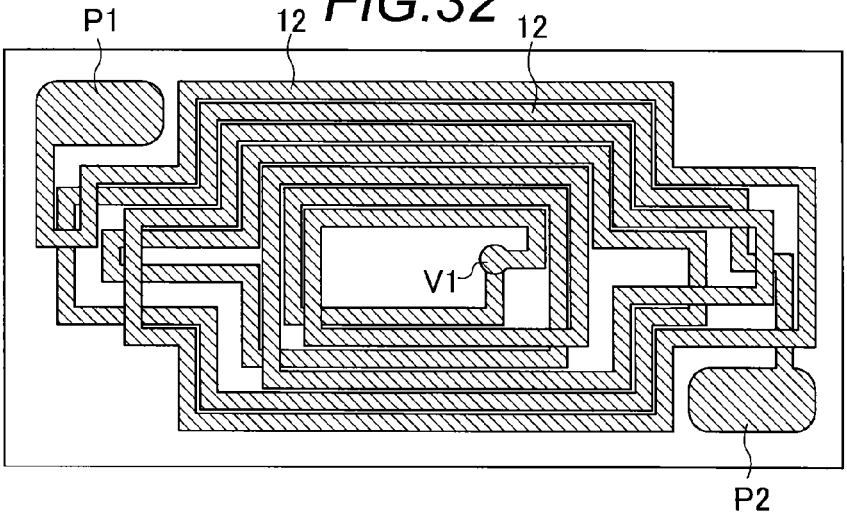
FIG. 32 is a plan view showing a first line of the coupler according to the eighth embodiment.
Figure 33:
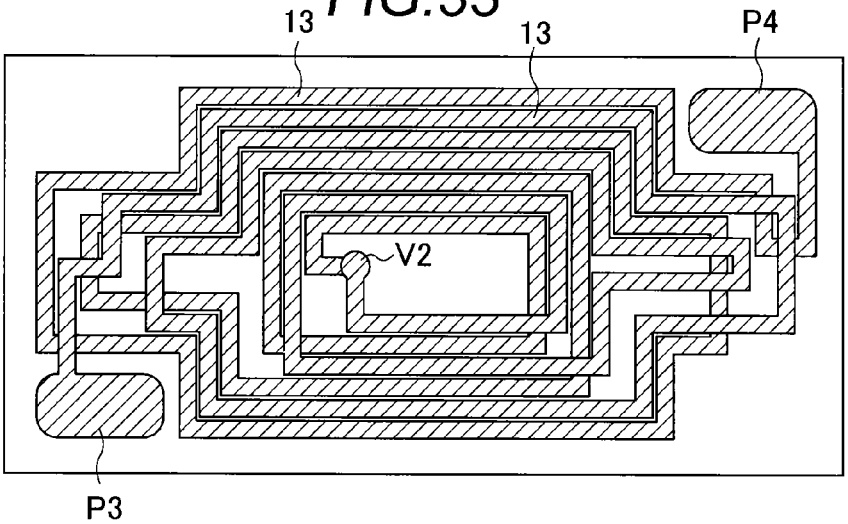
FIG. 33 is a plan view showing a second line of the coupler according to the eighth embodiment.
Figure 34:
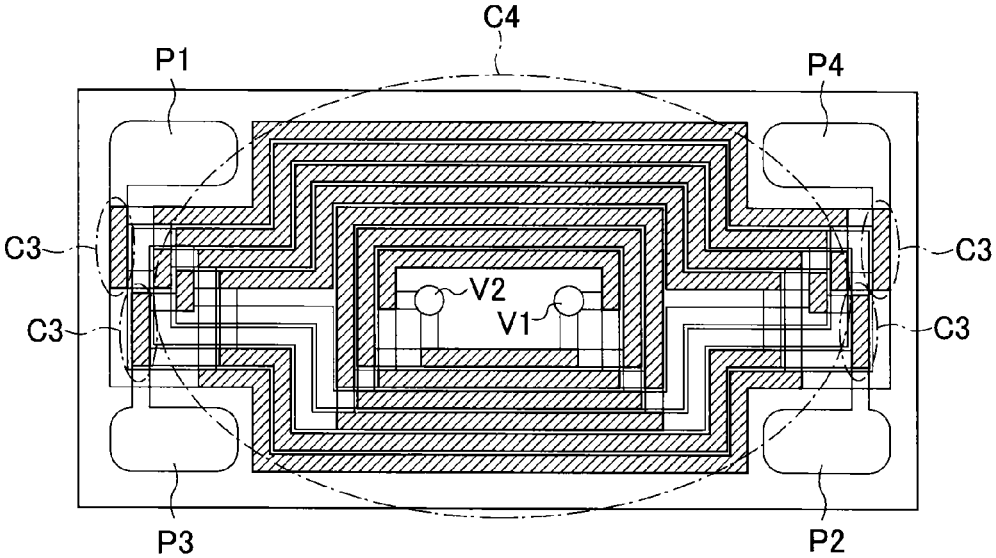
FIG. 34 is a diagram showing the placement of the first line and second line of the coupler according to the eighth embodiment in a see-through representation.
Figure 35A:
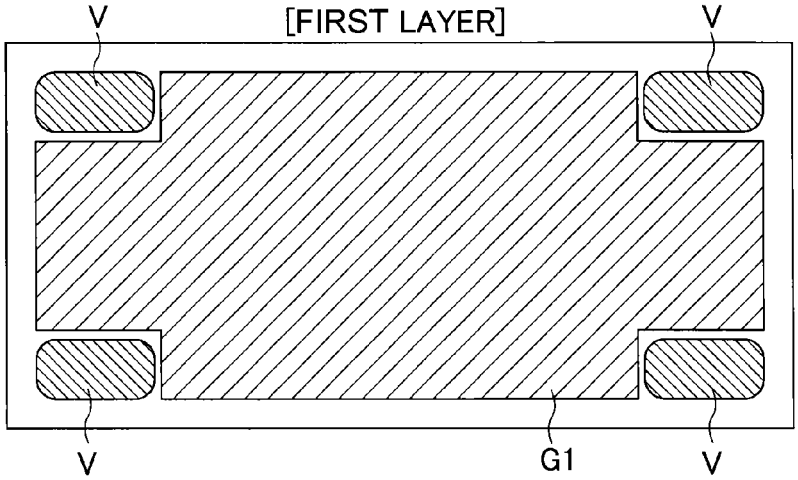
FIG. 35A is a plan views showing a first layer of a laminated board which constitutes a coupler which has coupling lines formed by inter-layer coupling, as a comparative example of the present invention.
Figure 35B:
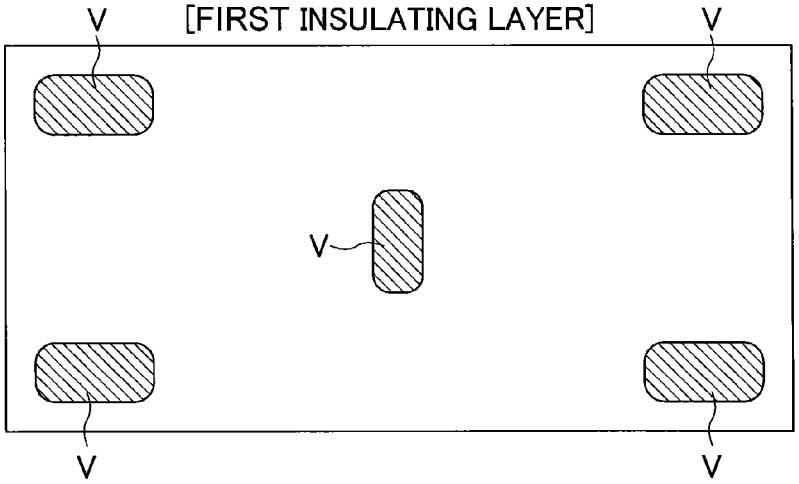
FIG. 35B is a plan view showing a first insulating layer of the laminated board which constitutes the coupler according to the comparative example.
Figure 35C:
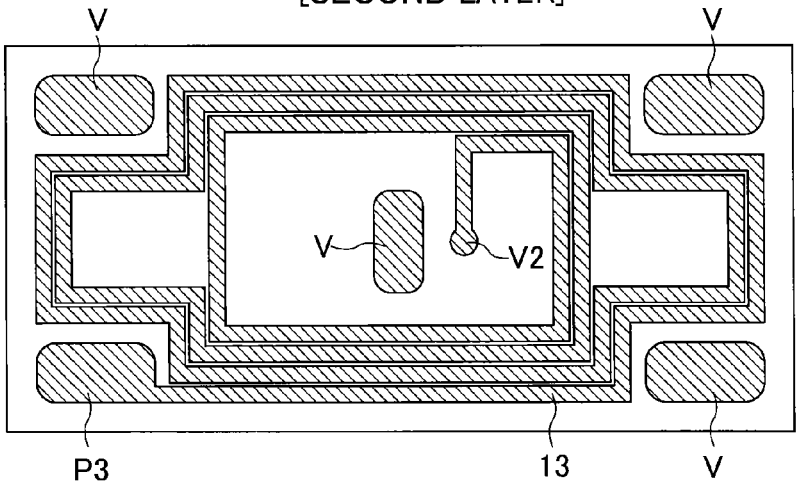
FIG. 35C is a plan view showing a second layer of the laminated board which constitutes the coupler according to the comparative example.
Figure 35D:
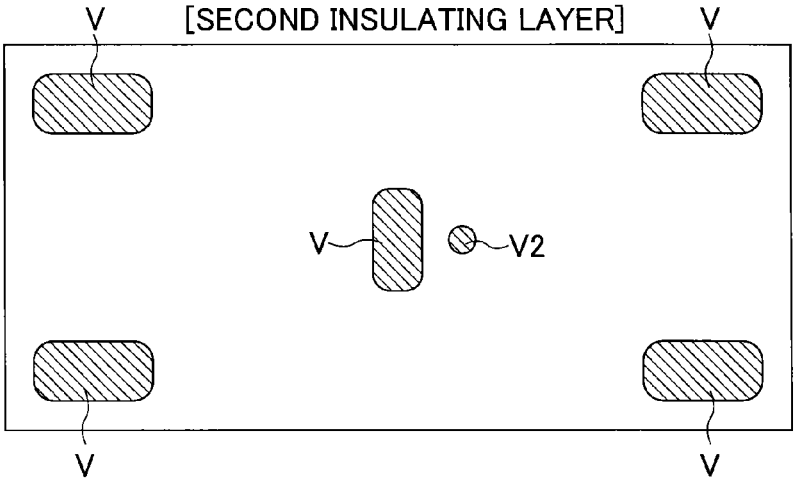
FIG. 35D is a plan view showing a second insulating layer of the laminated board which constitutes the coupler according to the comparative example.
Figure 35E:
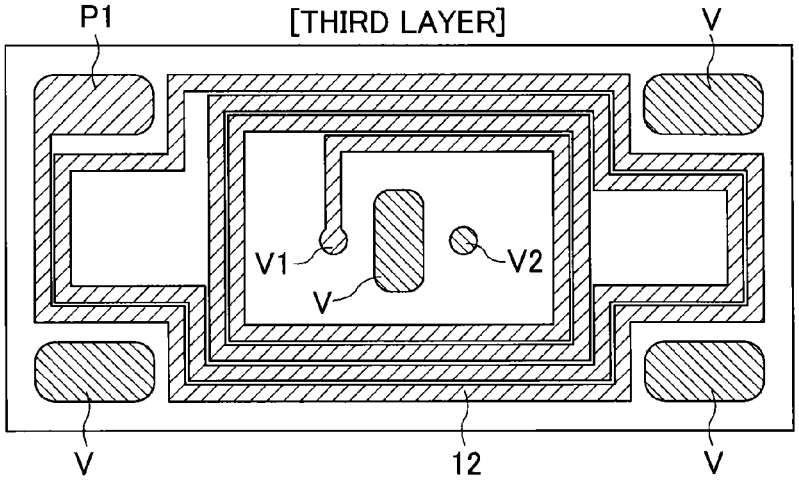
FIG. 35E is a plan view showing a third layer of the laminated board which constitutes the coupler according to the comparative example.
Figure 35F:
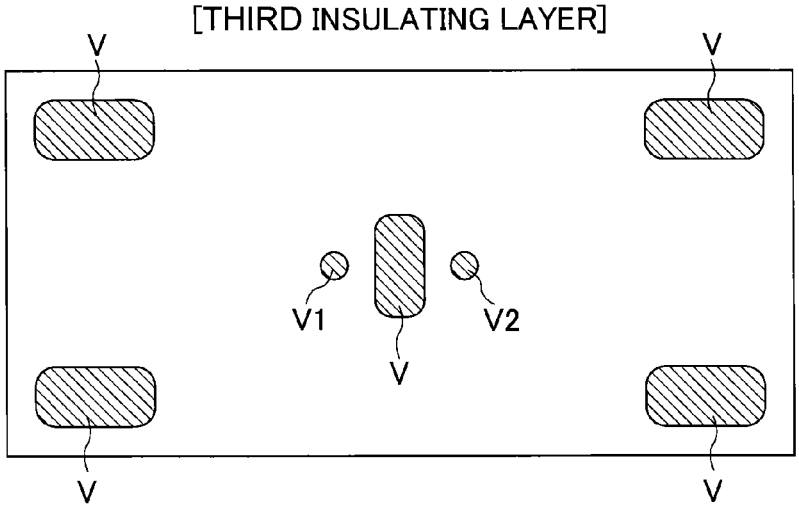
FIG. 35F is a plan view showing a third insulating layer of the laminated board which constitutes the coupler according to the comparative example.
Figure 35G:
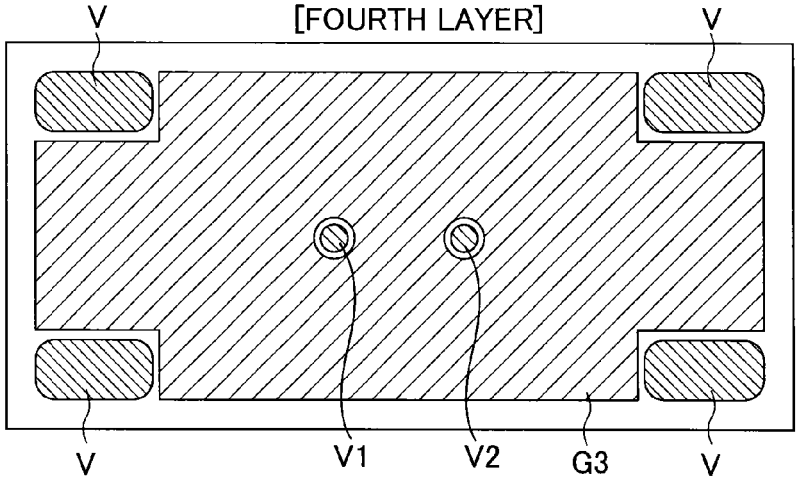
FIG. 35G is a plan view showing a fourth layer of the laminated board which constitutes the coupler according to the comparative example.
Figure 35H:
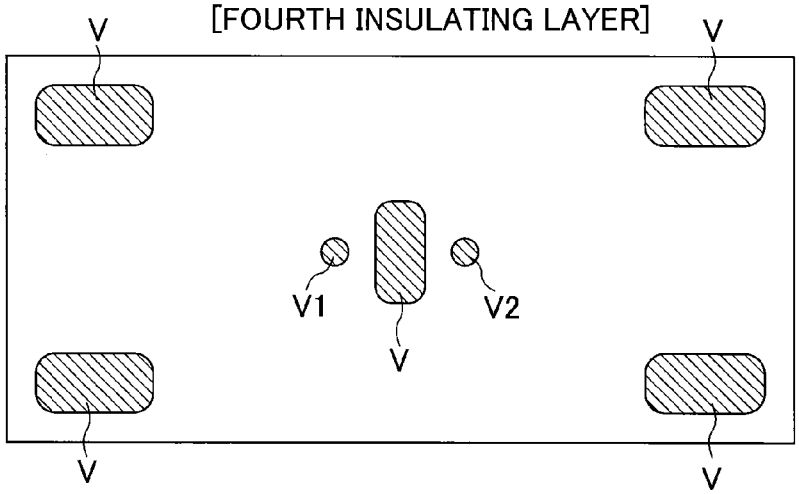
FIG. 35H is a plan view showing a fourth insulating layer of the laminated board which constitutes the coupler according to the comparative example.
Figure 35I:
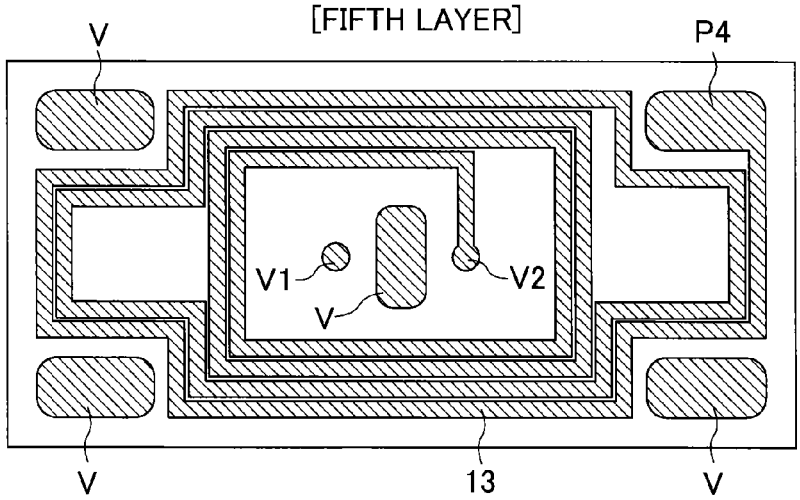
FIG. 35I is a plan view showing a fifth layer of the laminated board which constitutes the coupler according to the comparative example.
Figure 35J:
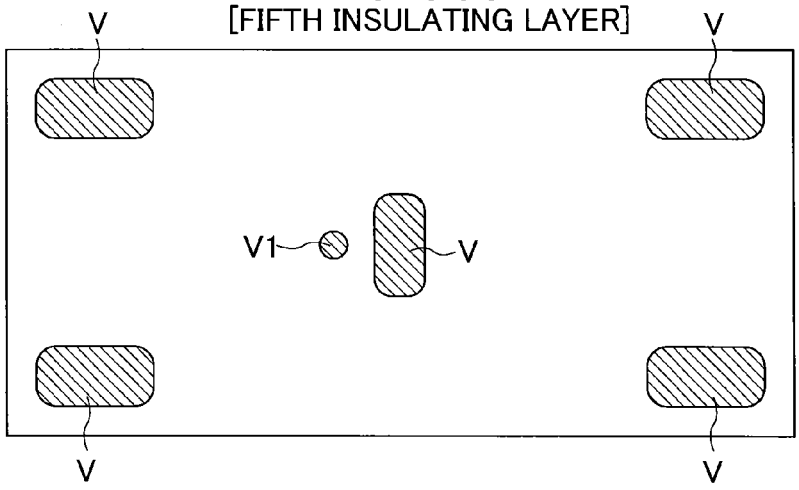
FIG. 35J is a plan view showing a fifth insulating layer of the laminated board which constitutes the coupler according to the comparative example.
Figure 35K:
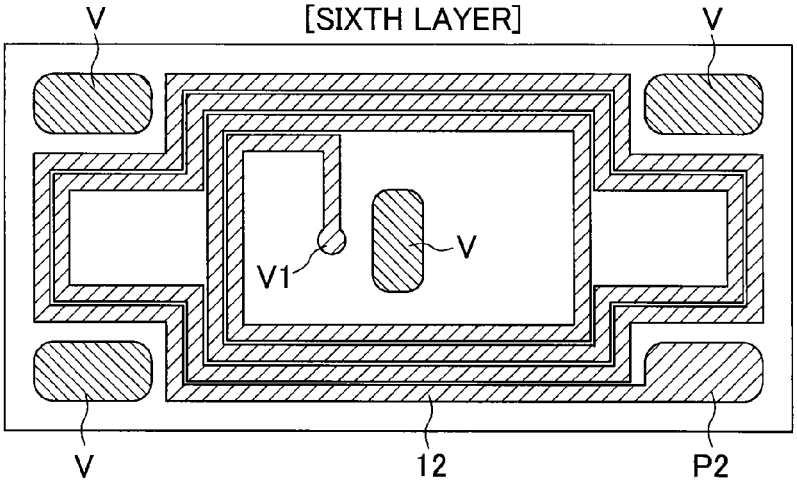
FIG. 35K is a plan view showing a sixth layer of the laminated board which constitutes the coupler according to the comparative example.
Figure 35L:
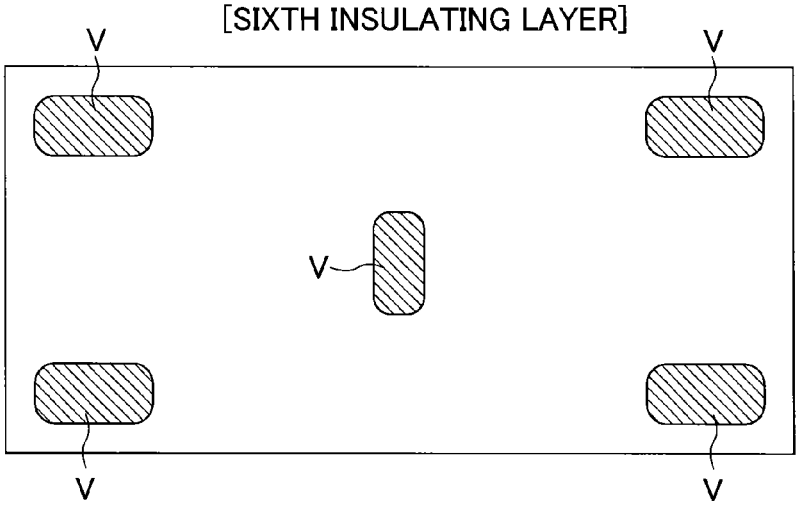
FIG. 35L is a plan view showing a sixth insulating layer of the laminated board which constitutes the coupler according to the comparative example.
Figure 35M:
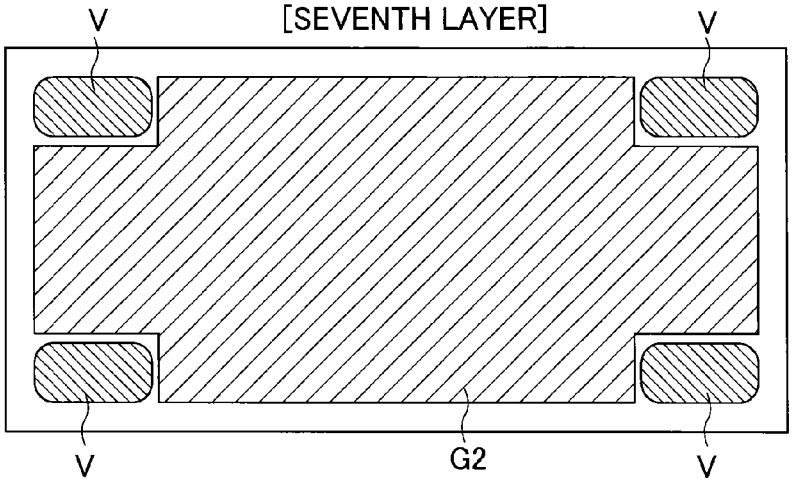
FIG. 35M is a plan view showing a seventh layer of the laminated board which constitutes the coupler according to the comparative example.
Figure 35N:
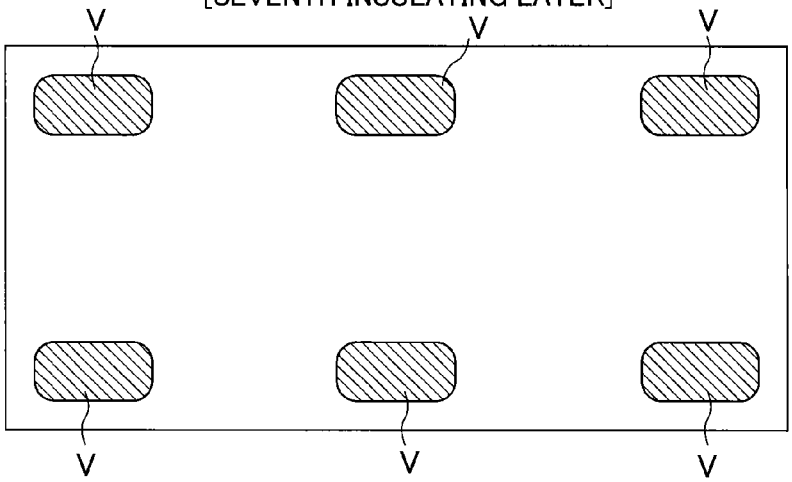
FIG. 35N is a plan view showing a seventh insulating layer of the laminated board which constitutes the coupler according to the comparative example.
Figure 35O:
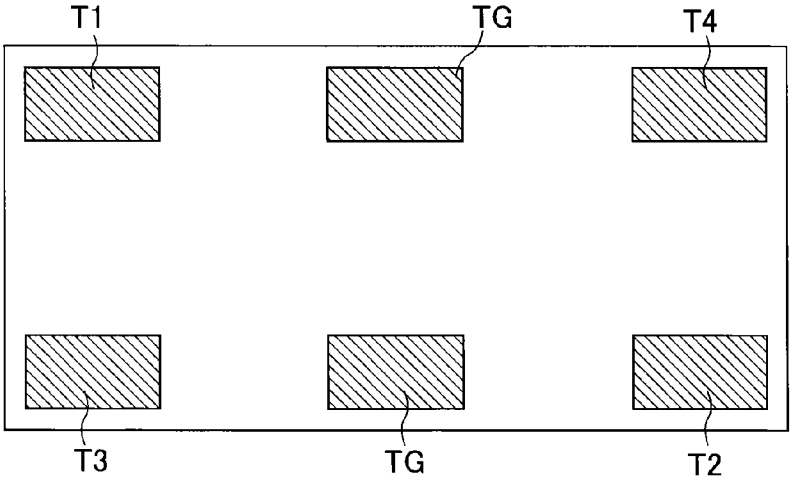
FIG. 35O is a plan view showing an eighth layer of the laminated board which constitutes the coupler according to the comparative example.
Figure 36A:
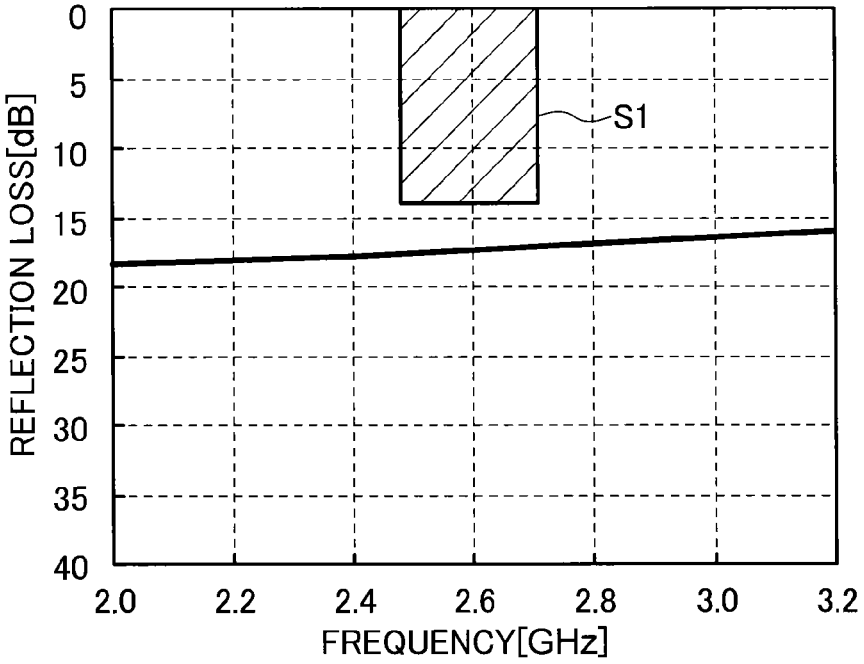
FIG. 36A is a graph representing a reflection loss of the coupler according to the comparative example.
Figure 36B:
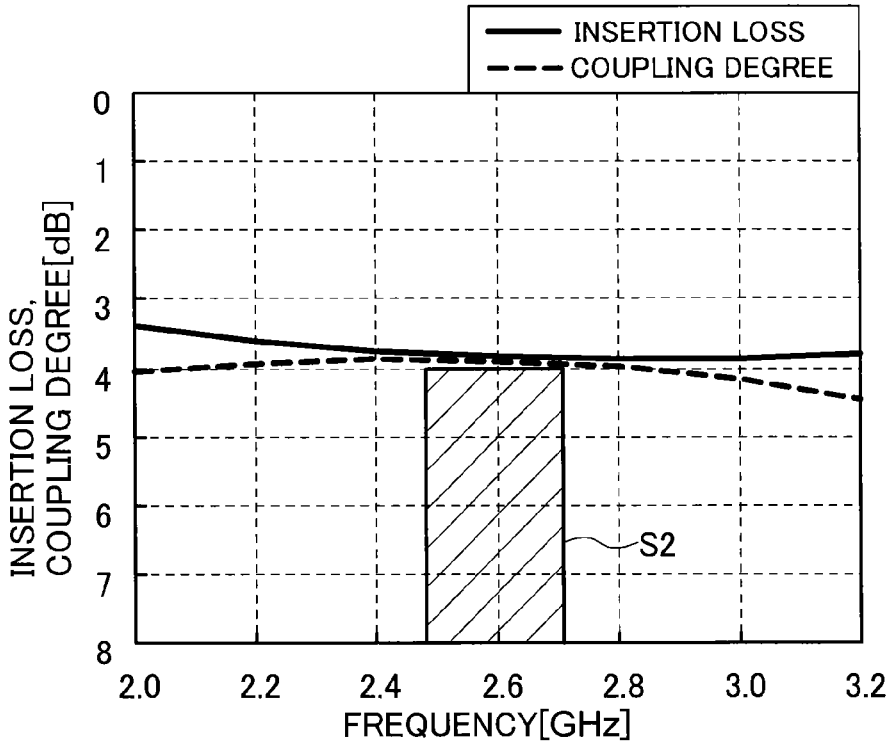
FIG. 36B is a graph representing an insertion loss and a coupling degree of the coupler according to the comparative example.
Figure 36C:
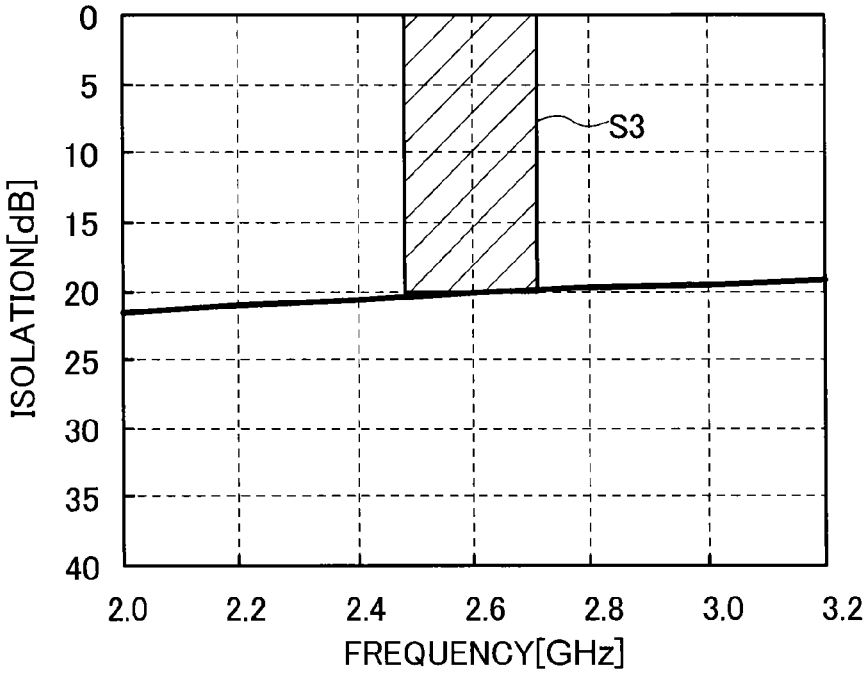
FIG. 36C is a graph representing isolation of the coupler according to the comparative example.
Figure 36D:
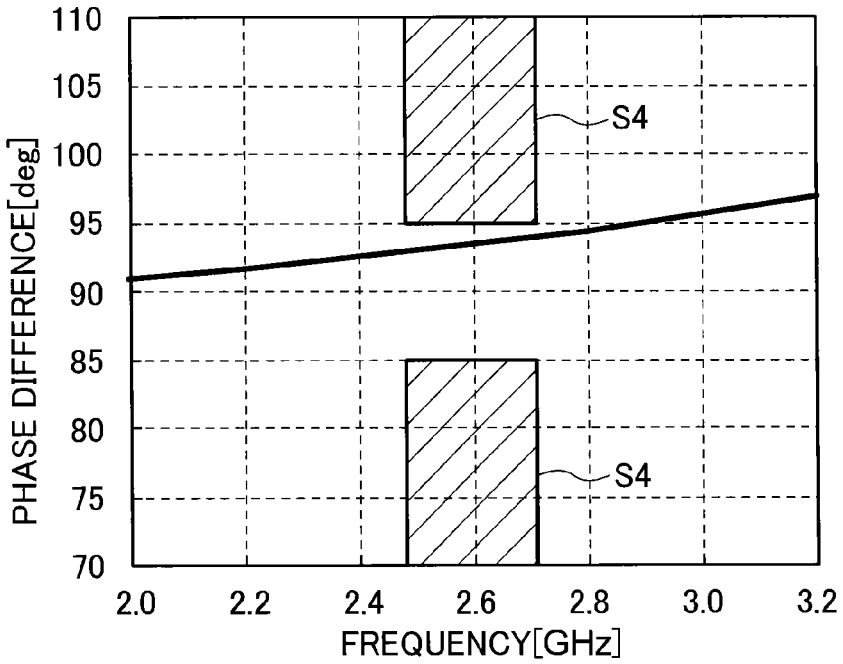
FIG. 36D is a graph representing a phase difference of the coupler according to the comparative example.

FIG. 8 shows the primary line 12 in a manner similar to FIG. 3, and FIG. 9 shows the secondary line 13 in a manner similar to FIG. 4, respectively. FIG. 10 shows the first conductor layer and second conductor layer in a see-through representation. As shown in FIG. 10, in this embodiment, in addition to the intra-layer coupling C1 in each of the first and second conductor layers, the primary line 12 on the first conductor layer and the secondary line 13 on the second conductor layer are disposed to overlap with each other in a central area of the board, when viewed in plan, where inter-layer coupling C2 is formed in the overlapping portion (see a hatched portion in FIG. 10).

As described above, this embodiment implements both of the intra-layer coupling C1 and inter-layer coupling C2, but does not implement double coupling. The present invention also includes such a coupler that does not implement double coupling. While a coupler implemented with double coupling is advantageous in simultaneously accomplishing a reduction in size and height and more satisfactory characteristics, even a coupler implemented with both intra-coupling C1 and inter-coupling C2 is more advantageous over a conventional coupler which implements only one of intra-layer coupling C1 or inter-layer coupling C2, in that it can increase the degree of freedom in arrangement of pattern by selecting one of intra-layer or inter-layer coupling schemes in a single coupler, i.e., extending the flexibility in arrangement of patterns for each line (first line and second line), ports, external connection electrodes, and the like within the laminated board, and increasing the degree of freedom in designing of the coupler.

Third-Fourth Embodiments

In a second aspect, a coupler provides for double coupling, but inter-layer coupling is only for one (first line or second line) of lines associated with intra-layer coupling (this coupling and associated space are hereinafter labeled "C3"). For reference, in a third aspect later described, a coupler provides for double coupling which involves mutual inter-layer coupling between intra-layer coupled lines, i.e., a second line and a first line on a second conductor are inter-layer coupled to both lines (first line and second line), respectively, which are intra-layer coupled on a first layer (this coupling and associated space are hereinafter labeled "C4").

FIGS. 11A-14 and FIGS. 15A-18 show a third embodiment and a fourth embodiment, respectively, which are couplers according to the second aspect. In these embodiments, intra-layer coupling is formed by a primary line 12 and a secondary line 13 on each of a first conductor layer and a second conductor layer, in a manner similar to the second embodiment, but the secondary line 13 on the second conductor layer participates in inter-layer coupling with the primary line 12 involved in the intra-layer coupling on the first conductor layer, while the primary line 12 on the first conductor layer participates in the inter-layer coupling with the secondary line 13 involved in the intra-layer coupling on the second conductor layer, thus resulting in the formation of double coupling space C3 (see FIGS. 14 and 18).

Fifth-Eighth Embodiments

In a third aspect, a coupler comprises the aforementioned double coupling space C4 which involves mutual inter-layer coupling between intra-layer coupled lines.

A fifth embodiment shown in FIGS. 19A-22, a sixth embodiment shown in FIGS. 23A-26, a seventh embodiment shown in FIGS. 27A-30, and an eighth embodiment shown in FIGS. 31A-34 comprise the double coupling space C4 according to the third aspect. The first embodiment described above also belongs to this third embodiment (see FIGS. 22, 26, 30, 34, and 5).

Among these embodiments, the couplers according to the seventh and eighth embodiments, and the aforementioned first embodiment, in particular, have the primary line 12 and secondary line 13 patterned such that the double couplings C3, C4 are formed in a spiral shape by a majority of the line length except for connection ends to the ports P1-P4 and vias V1, V2 (see FIGS. 30, 34, and 5), thus making it possible to simultaneously reduce the coupler in size and height and enhance the coupling of both lines 12, 13 to achieve satisfactory characteristics.

It should be understood by those skilled in the art that the foregoing description has been made on embodiments of the invention and that various changes and modifications may be made in the invention without departing from the spirit of the invention and the scope of the appended claims.

What is claimed is:

1. A directional coupler comprising:

a first line capable of transmitting a high-frequency signal therethrough;

a second line arranged for electromagnetic coupling with said first line;

a first port disposed at one end of said first line;

a second port disposed at the other end of said first line;

a third port disposed at one end of said second line; and a fourth port disposed at the other end of said second line, wherein said first and second lines and said first, second, third, and fourth ports are arranged in a laminated board having a plurality of conductor layers including a first conductor layer and a second conductor layer laminated through an insulating layer, said first line and said second line are disposed on said first conductor layer, said first line and said second line are routed on said first conductor layer to extend in close proximity to and in parallel with each other, to form an intra-layer coupling zone for developing electromagnetic coupling between said first line and said second line, said second line is routed on said second conductor layer such that said second line partially overlaps with said first line disposed on said first conductor layer with respect to a length-wise direction, when viewed in plan, to form an inter-layer coupling space for developing electromagnetic coupling between said second line on said second conductor layer and said first line on said first conductor layer, said laminated board is rectangular in shape when viewed in plan, said first conductor layer and said second conductor layer are both arranged horizontally within said laminated board and each have a first corner, a second corner adjacent to said first corner, a third corner located diagonal to said first corner when viewed in plan, and a fourth corner located diagonal to said second corner, said first port is disposed at a first corner on said first conductor layer, and said third port is disposed at a second corner adjacent to said first corner on said first conductor layer, said first line extending from said first port and said second line extending from said third port extend in close proximity to and in parallel with each other to form said intra-layer coupling zone on said first conductor layer, and said first line and said second line spirally extend to each draw a spiral from a peripheral area to a central area of said first conductor layer and to each be wound more than one turn, and said first line is connected to a first via hole in the central area of said first conductor layer, and is routed to a central area of said second conductor layer through said first via hole, and said second line is connected to a second via hole and routed to the central area of said second conductor layer through said second via hole, said second port is disposed at one of said third corner and said fourth corner on said second conductor layer, and said fourth port is disposed at the other of said third corner and said fourth corner or between said third corner and said fourth corner on said second conductor layer, said first line extending from said first via hole to said second port and said second line extending from said second via hole to said fourth port extend in close proximity to and in parallel with each other to form said intra-layer coupling zone within said second conductor layer, and said first line and said second line spirally extend to each draw a spiral from a central area to a peripheral area of said second conductor layer and to each be wound more than one turn, said intra-layer coupling zone spirally extending on said first conductor layer overlaps with said intra-layer coupling zone spirally extending on said second conductor layer, when viewed in plan, such that said first line on said first conductor layer and said second line on said second conductor layer overlap with each other, while said second line on said first conductor layer and said first line on said second conductor layer overlap with each other, when viewed in plan, to form said inter-layer coupling space, in a manner that a double coupling space is formed for developing the electromagnetic coupling on the same conductor layer and the electromagnetic coupling across different conductor layers, said double coupling space is formed substantially over the entire length of said first and second lines except for an end connected to said first port, an end connected to said third port, an end connected to said second port, an end connected to said fourth port, and an end connected to said via hole, and both said first line and said second line are disposed on only said first and second conductor layers.

2. A directional coupler according to claim 1, further comprising a terminal resistor disposed within said laminated board to be connected to said fourth port.

3. A directional coupler according to claim 1, wherein said first conductor layer and said second conductor layer have two short sides and two long sides respectively, said first corner is adjacent to said second corner in one of said two short sides, and said third corner is adjacent to said fourth corner in the other of said two short sides.

* * * * *